US012454824B2

(12) United States Patent
Pilz

(10) Patent No.: US 12,454,824 B2
(45) Date of Patent: Oct. 28, 2025

(54) BUILDING JOINT WITH COMPRESSIBLE FIRESTOPPING COMPONENT

(71) Applicant: CEMCO, LLC, City of Industry, CA (US)

(72) Inventor: Donald Anthony Pilz, Livermore, CA (US)

(73) Assignee: CEMCO, LLC, City of Industry, CA (US)

( * ) Notice: Subject to any disclaimer, the term of this patent is extended or adjusted under 35 U.S.C. 154(b) by 321 days.

(21) Appl. No.: 17/445,393

(22) Filed: Aug. 18, 2021

(65) Prior Publication Data

US 2022/0056686 A1 Feb. 24, 2022

Related U.S. Application Data

(60) Provisional application No. 63/110,293, filed on Nov. 5, 2020, provisional application No. 63/067,583, filed on Aug. 19, 2020.

(51) Int. Cl.
*E04B 1/94* (2006.01)
*E04B 2/58* (2006.01)

(52) U.S. Cl.
CPC ..... *E04B 1/947* (2013.01); *E04B 1/948* (2013.01); *E04B 2/58* (2013.01)

(58) Field of Classification Search
CPC ..... E04B 1/947; E04B 1/948; E04B 2/58
USPC ..... 52/232
See application file for complete search history.

(56) References Cited

U.S. PATENT DOCUMENTS

| | | | | |
|---|---|---|---|---|
| 661,832 | A | 11/1900 | Wilkinson | |
| 716,628 | A | 12/1902 | Dickey | |
| 965,595 | A | 7/1910 | Nicholson | |
| 1,130,722 | A | 3/1915 | Fletcher | |
| 1,563,651 | A | 12/1925 | Pomerantz | |
| 1,719,728 | A | 7/1929 | Saunders | |
| 2,020,576 | A | 11/1935 | Runde | |
| 2,027,882 | A * | 1/1936 | Ross | E04F 13/141 52/693 |
| 2,105,771 | A | 1/1938 | Holdsworth | |
| 2,114,386 | A | 4/1938 | Killion | |

(Continued)

FOREIGN PATENT DOCUMENTS

| | | |
|---|---|---|
| CA | 2234347 | 10/1999 |
| CA | 2498537 A1 | 8/2006 |

(Continued)

OTHER PUBLICATIONS

U.S. Appl. No. 17/453,158, filed Nov. 1, 2021, Pilz.

(Continued)

*Primary Examiner* — Brian D Mattei
*Assistant Examiner* — Joseph J. Sadlon
(74) *Attorney, Agent, or Firm* — VIA LLP

(57) ABSTRACT

A head of wall assembly includes a compressible component positioned within a deflection gap between an upper edge of the wallboard and a ceiling or other horizontal structural element. The compressible component includes an intumescent strip in contact with the ceiling or the upper edge of the wallboard. The compressible component held in place by a double-sided tape attached with the header track, the ceiling, or the upper edge of the wallboard. The double-sided tape can partially cover one side of the compressible component.

11 Claims, 6 Drawing Sheets

(56) References Cited

U.S. PATENT DOCUMENTS 2,218,426 A 10/1940 Hulbert, Jr.
2,235,761 A * 3/1941 Goldsmith ..... E04B 2/825 52/656.1
2,556,878 A 6/1951 Kohlhaas
2,664,739 A 1/1954 Marcy
2,683,927 A 7/1954 Maronek
2,733,786 A 2/1956 Drake
2,766,855 A 10/1956 Johnson et al.
2,796,158 A * 6/1957 Miles ..... E04B 2/768 52/772
2,994,114 A 8/1961 Black
3,041,682 A 7/1962 Alderfer et al.
3,129,792 A 4/1964 Gwynne
3,153,467 A 10/1964 Nelsson et al.
3,170,269 A * 2/1965 Dunnington ..... E04B 1/08 52/302.3
3,197,119 A * 7/1965 Hartig ..... B65D 31/147 383/50
3,271,920 A 9/1966 Downing, Jr.
3,286,420 A 11/1966 Kenneth
3,309,826 A 3/1967 Zinn
3,324,615 A 6/1967 Zinn
3,346,909 A 10/1967 Blackburn
3,355,852 A 12/1967 Lally
3,397,495 A 8/1968 Thompson
3,460,302 A 8/1969 Cooper
3,481,090 A 12/1969 Joseph
3,493,460 A 2/1970 Windecker
3,495,417 A 2/1970 Ratliff
3,537,219 A 11/1970 Navarre
3,562,985 A 2/1971 Nicosia
3,566,559 A 3/1971 Dickson
3,600,854 A 8/1971 Dallaire et al.
3,601,942 A * 8/1971 Wilson ..... E04B 1/18 52/316
3,604,167 A 9/1971 Hays
3,609,933 A 10/1971 Jahn et al.
3,648,419 A 3/1972 Marks
3,668,041 A 6/1972 Lonning
3,683,569 A 8/1972 Holm
3,696,569 A 10/1972 Didry
3,707,819 A 1/1973 Calhoun et al.
3,712,011 A * 1/1973 Husler ..... E04B 2/80 52/403.1
3,713,263 A 1/1973 Mullen
3,730,477 A 5/1973 Wavrunek
3,744,199 A 7/1973 Navarre
3,757,480 A 9/1973 Young
3,786,604 A 1/1974 Kramer
3,837,126 A 9/1974 Voiturier et al.
3,839,839 A 10/1974 Tillisch et al.
3,866,370 A 2/1975 Guarino et al.
3,908,328 A 9/1975 Nelsson
3,921,346 A 11/1975 Sauer et al.
3,922,830 A 12/1975 Guarino et al.
3,934,066 A 1/1976 Murch
3,935,681 A 2/1976 Voiturier et al.
3,949,532 A * 4/1976 Jonsson ..... B32B 5/245 52/270
3,950,912 A 4/1976 Lundberg et al.
3,955,330 A 5/1976 Wendt
3,964,214 A 6/1976 Wendt
3,974,607 A 8/1976 Balinski
3,976,825 A 8/1976 Anderberg
3,998,027 A 12/1976 Wendt et al.
4,011,704 A 3/1977 O'Konski
4,017,090 A 4/1977 Cohen
4,034,526 A 7/1977 Deslaugiers
4,058,947 A 11/1977 Earle et al.
4,093,818 A 6/1978 Thwaites et al.
4,103,463 A 8/1978 Dixon
4,114,335 A 9/1978 Carroll
4,122,203 A 10/1978 Stahl
4,130,972 A 12/1978 Varlonga
4,139,664 A 2/1979 Wenrick
4,144,335 A 3/1979 Edwards
4,144,385 A 3/1979 Downing
4,152,878 A 5/1979 Balinski
4,164,107 A 8/1979 Kraemling et al.
4,176,503 A 12/1979 Ting
4,178,728 A 12/1979 Ortmanns et al.
4,197,687 A 4/1980 Benoit
4,203,264 A 5/1980 Kiefer et al.
4,205,498 A 6/1980 Unayama
4,217,731 A 8/1980 Saino
4,269,890 A 5/1981 Breitling et al.
4,276,332 A 6/1981 Castle
4,281,494 A 8/1981 Weinar
4,283,892 A 8/1981 Brown
4,295,304 A 10/1981 Kim
4,318,253 A 3/1982 Wedel
4,320,611 A 3/1982 Freeman
4,324,835 A 4/1982 Keen
4,329,820 A 5/1982 Wendt
4,356,672 A 11/1982 Beckman et al.
4,361,994 A 12/1982 Carver
4,419,535 A 12/1983 O'Hara
4,424,653 A 1/1984 Heinen
4,433,732 A 2/1984 Licht et al.
4,434,592 A 3/1984 Reneault et al.
4,437,274 A 3/1984 Slocum et al.
4,454,690 A 6/1984 Dixon
4,461,120 A 7/1984 Hemmerling
4,467,578 A 8/1984 Weinar
4,480,419 A 11/1984 Crites
4,495,238 A 1/1985 Adiletta
4,497,150 A 2/1985 Wendt et al.
4,507,901 A 4/1985 Carroll
4,509,559 A 4/1985 Cheetham et al.
4,517,782 A 5/1985 Shamszadeh
4,530,877 A 7/1985 Hadley
4,574,454 A 3/1986 Dyson
4,575,979 A 3/1986 Mariani
4,578,913 A 4/1986 Eich
4,598,516 A 7/1986 Groshong
4,622,791 A 11/1986 Cook et al.
4,622,794 A 11/1986 Geortner
4,632,865 A 12/1986 Tzur
4,649,089 A 3/1987 Thwaites
4,663,204 A 5/1987 Langham
4,672,785 A 6/1987 Salvo
4,709,517 A 12/1987 Mitchell et al.
4,711,183 A 12/1987 Handler et al.
4,723,385 A 2/1988 Kallstrom
4,756,945 A 7/1988 Gibb
4,761,927 A 8/1988 O'Keeffe et al.
4,787,767 A 11/1988 Wendt
4,788,802 A 12/1988 Wokas
4,798,035 A 1/1989 Mitchell et al.
4,805,364 A 2/1989 Smolik
4,810,986 A 3/1989 Leupold
4,822,659 A 4/1989 Anderson et al.
4,825,610 A 5/1989 Gasteiger
4,830,913 A 5/1989 Ortmans et al.
4,845,904 A 7/1989 Menchetti
4,850,173 A 7/1989 Beyer et al.
4,850,385 A 7/1989 Harbeke
4,854,096 A 8/1989 Smolik
4,854,107 A 8/1989 Roberts
4,866,898 A 9/1989 LaRoche et al.
4,881,352 A 11/1989 Glockenstein
4,884,381 A * 12/1989 Betti ..... E04B 1/6801 52/396.06
4,885,884 A 12/1989 Schilger
4,897,976 A 2/1990 Williams et al.
4,899,510 A 2/1990 Propst
4,914,880 A 4/1990 Albertini
4,918,761 A 4/1990 Harbeke
4,930,276 A 6/1990 Bawa et al.
4,935,281 A 6/1990 Tolbert et al.
4,946,732 A * 8/1990 Cohen ..... F16L 59/10 428/351
4,982,540 A 1/1991 Thompson

(56) References Cited

U.S. PATENT DOCUMENTS 4,986,040 A 1/1991 Prewer et al.
4,987,719 A 1/1991 Goodson, Jr.
4,992,310 A 2/1991 Gelb et al.
5,010,702 A 4/1991 Daw et al.
5,040,345 A * 8/1991 Gilmour ..... E04B 2/825 52/241
5,058,342 A 10/1991 Crompton
5,067,676 A 11/1991 Belle
5,079,088 A 1/1992 McGroarty
5,090,170 A 2/1992 Propst
5,094,780 A 3/1992 von Bonin
5,098,778 A 3/1992 Minnick
5,103,589 A 4/1992 Crawford
5,105,594 A 4/1992 Kirchner
5,111,579 A 5/1992 Andersen
5,125,203 A 6/1992 Daw
5,127,203 A 7/1992 Paquette
5,127,760 A 7/1992 Brady
5,140,792 A 8/1992 Daw et al.
5,146,723 A 9/1992 Greenwood et al.
5,152,113 A 10/1992 Guddas
5,155,957 A 10/1992 Robertson et al.
5,157,883 A 10/1992 Meyer
5,157,887 A 10/1992 Watterworth, III
5,167,876 A 12/1992 Lem
5,173,515 A 12/1992 von Bonin et al.
5,203,132 A 4/1993 Smolik
5,205,099 A 4/1993 Grünhage et al.
5,212,914 A 5/1993 Martin et al.
5,214,894 A 6/1993 Glesser-Lott
5,222,335 A 6/1993 Petrecca
5,228,254 A 7/1993 Honeycutt, Jr.
5,244,709 A 9/1993 Vanderstukken
5,279,087 A 1/1994 Mann
5,279,088 A 1/1994 Heydon
5,279,091 A 1/1994 Williams et al.
5,285,615 A 2/1994 Gilmour
5,307,600 A 5/1994 Simon et al.
5,315,804 A 5/1994 Attalla
5,319,339 A 6/1994 Leupold
5,325,651 A 7/1994 Meyer et al.
5,339,577 A 8/1994 Snyder
5,347,780 A 9/1994 Richards et al.
5,367,850 A 11/1994 Nicholas
5,374,036 A 12/1994 Rogers et al.
5,376,429 A 12/1994 McGroarty
5,390,458 A 2/1995 Menchetti
5,390,465 A 2/1995 Rajecki
5,394,665 A 3/1995 Johnson
5,412,919 A 5/1995 Pellock et al.
5,433,991 A 7/1995 Boyd, Jr. et al.
5,452,551 A 9/1995 Charland et al.
5,454,203 A 10/1995 Turner
5,456,050 A 10/1995 Ward
5,460,864 A 10/1995 Heitkamp
5,471,791 A 12/1995 Keller
5,471,805 A 12/1995 Becker
5,475,961 A 12/1995 Menchetti
5,477,652 A 12/1995 Torrey et al.
5,481,834 A 1/1996 Kowalczyk et al.
5,502,937 A 4/1996 Wilson
5,505,031 A 4/1996 Heydon
5,531,051 A 7/1996 Chenier, Jr. et al.
5,552,185 A 9/1996 De Keyser
5,592,796 A 1/1997 Landers
5,604,024 A 2/1997 von Bonin
5,607,758 A 3/1997 Schwartz
5,644,877 A 7/1997 Wood
5,687,532 A 11/1997 Torrey
5,687,538 A 11/1997 Frobosilo et al.
5,689,922 A 11/1997 Daudet
5,694,726 A 12/1997 Wu
5,709,821 A 1/1998 von Bonin et al.
5,724,784 A 3/1998 Menchetti
5,735,100 A 4/1998 Campbell
5,740,635 A 4/1998 Gil et al.
5,740,643 A 4/1998 Huntley
5,755,066 A 5/1998 Becker
5,765,332 A 6/1998 Landin et al.
5,782,690 A 7/1998 Gustafson et al.
5,787,651 A 8/1998 Horn et al.
5,797,233 A 8/1998 Hascall
5,798,679 A 8/1998 Pissanetzky
5,806,261 A 9/1998 Huebner et al.
5,809,721 A 9/1998 Antropius
5,820,958 A 10/1998 Swallow
5,822,935 A 10/1998 Mitchell et al.
5,870,866 A 2/1999 Herndon
5,913,788 A 6/1999 Herren
5,921,041 A 7/1999 Egri, II
5,927,041 A 7/1999 Sedlmeier et al.
5,930,963 A 8/1999 Nichols
5,930,968 A 8/1999 Pullman
5,945,182 A 8/1999 Fowler et al.
5,950,385 A 9/1999 Herren
5,968,615 A 10/1999 Schlappa
5,968,669 A 10/1999 Liu et al.
5,970,672 A 10/1999 Robinson
5,974,750 A 11/1999 Landin et al.
5,974,753 A 11/1999 Hsu
6,023,898 A 2/2000 Josey
6,058,668 A 5/2000 Herren
6,061,985 A 5/2000 Kraus et al.
6,086,709 A * 7/2000 Hills ..... B05B 12/24 428/41.7
6,110,559 A 8/2000 De Keyser
6,116,404 A 9/2000 Heuft et al.
6,119,411 A 9/2000 Mateu Gil et al.
6,119,430 A * 9/2000 Nicholls ..... E02D 29/02 52/118
6,125,608 A 10/2000 Charlson
6,128,874 A 10/2000 Olson et al.
6,128,877 A 10/2000 Goodman et al.
6,131,352 A 10/2000 Barnes et al.
6,151,858 A 11/2000 Ruiz et al.
6,153,668 A 11/2000 Gestner et al.
6,176,053 B1 1/2001 St. Germain
6,182,407 B1 2/2001 Turpin et al.
6,189,277 B1 2/2001 Boscamp
6,207,077 B1 3/2001 Burnell-Jones
6,207,085 B1 3/2001 Ackerman
6,213,679 B1 4/2001 Frobosilo et al.
6,216,404 B1 4/2001 Vellrath
6,233,888 B1 5/2001 Wu
6,256,948 B1 7/2001 Van Dreumel
6,256,960 B1 7/2001 Babcock et al.
6,279,289 B1 8/2001 Soder et al.
6,305,133 B1 10/2001 Cornwall
6,318,044 B1 11/2001 Campbell
6,374,558 B1 4/2002 Surowiecki
6,381,913 B2 5/2002 Herren
6,393,774 B1 5/2002 Fisher
6,405,502 B1 6/2002 Cornwall
6,408,578 B1 6/2002 Tanaka et al.
6,430,881 B1 8/2002 Daudet et al.
6,470,638 B1 10/2002 Larson
6,487,825 B1 12/2002 Silik
6,536,169 B2 3/2003 Dykhoff
6,574,930 B2 6/2003 Kiser
6,595,383 B2 7/2003 Pietrantoni
6,606,831 B2 8/2003 Degelsegger
6,647,691 B2 11/2003 Becker et al.
6,668,499 B2 12/2003 Degelsegger
6,679,015 B1 1/2004 Cornwall
6,688,056 B2 2/2004 von Hoyningen Huene et al.
6,698,146 B2 3/2004 Morgan et al.
6,705,047 B2 3/2004 Yulkowski
6,708,627 B1 3/2004 Wood
6,711,871 B2 3/2004 Beirise et al.
6,732,481 B2 5/2004 Stahl, Sr.
6,739,926 B2 5/2004 Riach et al.
6,748,705 B2 6/2004 Orszulak
6,783,345 B2 8/2004 Morgan et al.
6,792,733 B2 9/2004 Wheeler et al.

(56) References Cited

U.S. PATENT DOCUMENTS 6,799,404 B2 10/2004 Spransy
6,820,382 B1 11/2004 Chambers et al.
6,843,035 B1 1/2005 Glynn
6,854,237 B2 2/2005 Surowiecki
6,871,470 B1 3/2005 Stover
6,944,997 B2 9/2005 Verkamp
6,951,162 B1 10/2005 Shockey et al.
6,955,017 B2 10/2005 Hilburn
6,996,944 B2 2/2006 Shaw
7,043,880 B2 5/2006 Morgan et al.
7,059,092 B2 6/2006 Harkins et al.
7,104,024 B1 9/2006 deGirolamo et al.
7,152,385 B2 12/2006 Morgan et al.
7,191,845 B2 3/2007 Loar
7,216,465 B2 * 5/2007 Saldana ..... E04C 3/11 52/715
7,240,905 B1 7/2007 Stahl
7,251,918 B2 8/2007 Reif et al.
7,284,355 B2 10/2007 Becker et al.
7,302,776 B2 12/2007 Duncan et al.
7,398,856 B2 7/2008 Foster et al.
7,413,024 B1 8/2008 Simontacchi et al.
7,441,565 B2 10/2008 Imamura et al.
7,487,591 B2 2/2009 Harkins et al.
7,497,056 B2 3/2009 Surowiecki
7,506,478 B2 3/2009 Bobenhausen
7,513,082 B2 4/2009 Johnson
7,540,118 B2 6/2009 Jensen
7,594,331 B2 9/2009 Andrews et al.
7,603,823 B2 10/2009 Cann
7,610,725 B2 11/2009 Willert
7,617,643 B2 11/2009 Pilz et al.
7,681,365 B2 3/2010 Klein
7,685,792 B2 3/2010 Stahl, Sr. et al.
7,716,891 B2 5/2010 Radford
7,735,295 B2 6/2010 Surowiecki
7,752,817 B2 7/2010 Pilz et al.
7,770,348 B2 8/2010 Tollenaar
7,775,006 B2 8/2010 Giannos
7,776,170 B2 8/2010 Yu et al.
7,797,893 B2 9/2010 Stahl, Sr. et al.
7,810,295 B2 10/2010 Thompson
7,814,718 B2 10/2010 Klein
7,827,738 B2 11/2010 Abrams et al.
7,836,652 B2 11/2010 Futterman
7,866,108 B2 1/2011 Klein
7,870,698 B2 1/2011 Tonyan et al.
7,921,537 B2 4/2011 Rodlin
7,921,614 B2 4/2011 Fortin et al.
7,941,981 B2 5/2011 Shaw
7,950,198 B2 5/2011 Pilz et al.
7,966,778 B2 6/2011 Klein
7,984,592 B1 7/2011 Jiras
8,029,345 B2 10/2011 Messmer et al.
8,056,293 B2 11/2011 Klein
8,061,099 B2 11/2011 Andrews
8,062,108 B2 11/2011 Carlson et al.
8,069,625 B2 12/2011 Harkins et al.
8,074,412 B1 12/2011 Gogan et al.
8,074,416 B2 12/2011 Andrews
8,079,188 B2 12/2011 Swartz et al.
8,087,205 B2 1/2012 Pilz et al.
8,096,084 B2 1/2012 Studebaker et al.
8,100,164 B2 1/2012 Goodman et al.
8,132,376 B2 3/2012 Pilz et al.
8,136,314 B2 3/2012 Klein
8,151,526 B2 4/2012 Klein
8,181,404 B2 5/2012 Klein
8,225,581 B2 7/2012 Strickland et al.
8,281,552 B2 10/2012 Pilz et al.
8,286,397 B2 10/2012 Shaw
8,307,610 B2 * 11/2012 Landers ..... E04C 3/07 52/483.1
8,318,304 B2 11/2012 Valenziano
8,322,094 B2 12/2012 Pilz et al.
8,353,139 B2 1/2013 Pilz
8,375,666 B2 2/2013 Stahl, Jr. et al.
8,389,107 B2 3/2013 Riebel et al.
8,413,394 B2 4/2013 Pilz et al.
8,453,413 B2 6/2013 Matiere
8,468,759 B2 6/2013 Klein
8,495,844 B1 7/2013 Johnson
8,499,512 B2 8/2013 Pilz et al.
8,539,732 B2 9/2013 Leahy
8,541,084 B2 9/2013 Deiss et al.
8,544,226 B2 10/2013 Rubel
8,551,594 B2 * 10/2013 Deiss ..... E04B 1/6812 428/40.1
8,555,566 B2 10/2013 Pilz et al.
8,578,672 B2 11/2013 Mattox et al.
8,584,415 B2 11/2013 Stahl, Jr. et al.
8,590,231 B2 11/2013 Pilz
8,595,999 B1 12/2013 Pilz et al.
8,596,019 B2 12/2013 Aitken
8,601,760 B2 12/2013 Hilburn, Jr.
8,607,519 B2 12/2013 Hilburn
8,640,415 B2 2/2014 Pilz et al.
8,646,235 B2 2/2014 Hilburn, Jr.
8,671,632 B2 3/2014 Pilz et al.
8,695,301 B2 4/2014 Lutkajtis et al.
8,728,608 B2 5/2014 Maisch
8,782,977 B2 7/2014 Burgess
8,793,946 B2 8/2014 Stahl et al.
8,793,947 B2 8/2014 Pilz et al.
8,826,599 B2 9/2014 Stahl
8,871,326 B2 10/2014 Flennert
8,938,922 B2 1/2015 Pilz et al.
8,950,132 B2 2/2015 Collins et al.
8,955,275 B2 2/2015 Stahl, Jr.
8,973,319 B2 3/2015 Pilz et al.
9,045,899 B2 6/2015 Pilz et al.
9,127,454 B2 9/2015 Pilz et al.
9,151,042 B2 10/2015 Simon et al.
9,157,232 B2 10/2015 Stahl, Jr.
9,163,444 B1 10/2015 Fontijn et al.
9,206,596 B1 12/2015 Robinson
9,284,730 B2 3/2016 Klein
9,290,932 B2 3/2016 Pilz et al.
9,290,934 B2 3/2016 Pilz et al.
9,316,133 B2 4/2016 Schnitta
9,371,644 B2 6/2016 Pilz et al.
9,382,709 B2 7/2016 Collins et al.
9,388,583 B2 * 7/2016 Lindberg ..... E04F 15/02038
9,458,628 B2 10/2016 Pilz et al.
9,481,998 B2 11/2016 Pilz et al.
9,499,973 B2 * 11/2016 Yoon ..... E04B 2/70
9,506,245 B2 11/2016 Mackintosh
9,506,246 B2 11/2016 Joseph et al.
9,512,614 B2 12/2016 Klein et al.
9,523,193 B2 12/2016 Pilz
9,551,148 B2 1/2017 Pilz
9,587,399 B2 * 3/2017 Jakobsen ..... E04B 1/7608
9,616,259 B2 4/2017 Pilz et al.
9,637,914 B2 5/2017 Pilz et al.
9,677,268 B2 * 6/2017 Knight ..... E04B 1/388
9,683,364 B2 * 6/2017 Pilz ..... E04B 1/948
9,719,253 B2 8/2017 Stahl, Jr. et al.
9,739,052 B2 8/2017 Pilz et al.
9,739,054 B2 8/2017 Pilz et al.
9,752,318 B2 9/2017 Pilz
9,834,924 B2 * 12/2017 Lopez ..... E04B 2/828
9,845,597 B1 * 12/2017 Shaw ..... E04B 1/94
9,879,421 B2 1/2018 Pilz
9,883,607 B2 1/2018 Bernard
9,885,178 B1 2/2018 Barnes et al.
9,909,298 B2 3/2018 Pilz
9,931,527 B2 4/2018 Pilz et al.
9,995,039 B2 6/2018 Pilz et al.
9,995,040 B2 6/2018 Stahl et al.
10,000,923 B2 6/2018 Pilz
10,010,805 B2 7/2018 Maxam et al.
10,011,983 B2 7/2018 Pilz et al.
10,036,155 B2 7/2018 Carless
10,047,521 B2 * 8/2018 Hernandez, Sr. ..... E04B 9/008

(56) References Cited

U.S. PATENT DOCUMENTS 10,066,385 B2 * 9/2018 Foerg ..... E04B 1/84
10,077,550 B2 9/2018 Pilz
10,100,514 B2 * 10/2018 Klein ..... E04B 2/7411
10,150,151 B1 * 12/2018 Boyd ..... H01J 9/28
10,166,418 B2 1/2019 Foerg et al.
10,174,499 B1 1/2019 Tinianov et al.
10,184,246 B2 1/2019 Pilz et al.
10,203,035 B1 2/2019 Robinson
10,214,901 B2 2/2019 Pilz et al.
10,227,775 B2 3/2019 Pilz et al.
10,246,871 B2 4/2019 Pilz
10,309,100 B2 6/2019 Long et al.
10,323,409 B1 6/2019 Robinson
10,323,411 B2 6/2019 Ackerman et al.
10,406,389 B2 9/2019 Pilz et al.
10,443,232 B2 * 10/2019 Heiden ..... E04C 2/205
10,472,819 B2 11/2019 Klein et al.
10,480,654 B2 11/2019 Robinson
10,494,818 B2 12/2019 Maziarz
10,519,652 B2 * 12/2019 Klein ..... E04B 1/947
10,538,915 B1 1/2020 Zemler et al.
10,563,399 B2 2/2020 Pilz et al.
10,612,235 B2 * 4/2020 Pues ..... E04B 2/7409
10,619,347 B2 4/2020 Pilz et al.
10,626,598 B2 4/2020 Klein
10,669,710 B2 6/2020 Förg
10,689,842 B2 6/2020 Pilz
10,731,338 B1 8/2020 Zemler et al.
10,753,084 B2 8/2020 Pilz et al.
10,830,385 B2 * 11/2020 Parks ..... F16L 59/022
10,851,542 B2 12/2020 Hensley et al.
10,900,223 B2 1/2021 Pilz
10,914,065 B2 2/2021 Pilz
10,919,262 B2 2/2021 Zhu et al.
10,920,416 B2 2/2021 Klein et al.
10,954,670 B2 3/2021 Pilz
11,041,306 B2 6/2021 Pilz et al.
11,060,283 B2 * 7/2021 Pilz ..... E04B 2/7411
11,111,666 B2 9/2021 Pilz
11,118,346 B2 9/2021 Klein et al.
11,136,767 B2 * 10/2021 Förg ..... E04B 1/8209
11,141,613 B2 10/2021 Pilz et al.
11,149,432 B2 * 10/2021 Gatland ..... E04B 1/942
11,162,259 B2 11/2021 Pilz
11,186,065 B2 * 11/2021 Chang ..... C09J 5/00
11,230,839 B2 1/2022 Klein et al.
11,268,274 B2 3/2022 Pilz
11,299,884 B2 4/2022 Stahl, Jr. et al.
11,313,121 B2 4/2022 Quirijns et al.
11,359,369 B2 6/2022 Sonney et al.
11,401,711 B2 8/2022 Klein
11,421,417 B2 8/2022 Pilz et al.
11,466,449 B2 10/2022 Pilz et al.
11,486,150 B2 11/2022 Stahl et al.
11,512,464 B2 11/2022 Klein
11,560,712 B2 1/2023 Pilz et al.
11,674,304 B2 6/2023 Landreth et al.
11,697,937 B2 7/2023 Campbell
11,713,572 B2 8/2023 Zemler et al.
11,732,465 B2 8/2023 Austin et al.
11,773,587 B2 10/2023 Pilz et al.
11,802,404 B2 10/2023 Pilz et al.
11,808,036 B2 11/2023 Klein et al.
11,866,932 B2 1/2024 Pilz et al.
11,873,636 B2 1/2024 Pilz et al.
11,891,800 B2 2/2024 Pilz
11,896,859 B2 2/2024 Pilz et al.
11,898,346 B2 2/2024 Pilz
11,905,705 B2 2/2024 Pilz et al.
11,920,343 B2 3/2024 Pilz
11,920,344 B2 3/2024 Pilz
11,933,042 B2 3/2024 Pilz
2002/0029535 A1 3/2002 Loper
2002/0095908 A1 7/2002 Kiser
2002/0160149 A1 10/2002 Garofalo
2002/0170249 A1 11/2002 Yulkowski
2003/0074849 A1 * 4/2003 Surowiecki ..... E04C 3/07 52/301
2003/0079425 A1 5/2003 Morgan et al.
2003/0089062 A1 5/2003 Morgan et al.
2003/0196401 A1 10/2003 Surowiecki
2003/0213211 A1 11/2003 Morgan et al.
2004/0010998 A1 1/2004 Turco
2004/0016191 A1 1/2004 Whitty
2004/0045234 A1 3/2004 Morgan et al.
2004/0139684 A1 7/2004 Menendez
2004/0149390 A1 8/2004 Monden et al.
2004/0151922 A1 * 8/2004 Cohen ..... B32B 37/153 428/458
2004/0157012 A1 8/2004 Miller et al.
2004/0211150 A1 10/2004 Bobenhausen
2005/0031843 A1 2/2005 Robinson et al.
2005/0034389 A1 * 2/2005 Boot ..... E04B 1/948 52/204.2
2005/0183361 A1 8/2005 Frezza
2005/0246973 A1 11/2005 Jensen
2006/0032163 A1 2/2006 Korn
2006/0096200 A1 5/2006 Daudet
2006/0123723 A1 6/2006 Weir et al.
2006/0137293 A1 6/2006 Klein
2006/0213138 A1 9/2006 Milani et al.
2006/0261223 A1 11/2006 Orndorff et al.
2006/0277841 A1 12/2006 Majusiak
2007/0056245 A1 3/2007 Edmondson
2007/0068101 A1 3/2007 Weir et al.
2007/0125027 A1 6/2007 Klein
2007/0130873 A1 6/2007 Fisher
2007/0175140 A1 8/2007 Giannos
2007/0193202 A1 8/2007 Rice
2007/0261343 A1 11/2007 Stahl, Sr.
2008/0053013 A1 3/2008 Tollenaar
2008/0087366 A1 4/2008 Yu et al.
2008/0134589 A1 6/2008 Abrams et al.
2008/0172967 A1 7/2008 Hilburn
2008/0196337 A1 8/2008 Surowiecki
2008/0250738 A1 10/2008 Howchin
2009/0094912 A1 * 4/2009 Klein ..... E04B 2/7457 52/232
2009/0107064 A1 4/2009 Bowman
2009/0197060 A1 8/2009 Cho
2009/0223159 A1 9/2009 Colon
2009/0241465 A1 10/2009 Majors
2009/0260303 A1 * 10/2009 Jensen ..... A62C 3/14 52/95
2009/0282760 A1 11/2009 Sampson et al.
2009/0320392 A1 12/2009 Nowoczin et al.
2010/0071292 A1 3/2010 Futterman
2010/0115868 A1 * 5/2010 Shaw ..... E04B 1/948 52/396.01
2010/0170172 A1 * 7/2010 Klein ..... E04B 2/7411 52/309.1
2010/0199583 A1 8/2010 Behrens et al.
2010/0266781 A1 10/2010 Kusinski et al.
2011/0011019 A1 1/2011 Stahl, Jr. et al.
2011/0016808 A1 1/2011 Hulburn, Jr.
2011/0041415 A1 2/2011 Esposito
2011/0056163 A1 3/2011 Kure
2011/0067328 A1 3/2011 Naccarato et al.
2011/0099928 A1 5/2011 Klein et al.
2011/0113709 A1 5/2011 Pilz et al.
2011/0123801 A1 5/2011 Valenciano
2011/0146180 A1 6/2011 Klein
2011/0167742 A1 7/2011 Klein
2011/0185656 A1 8/2011 Klein
2011/0214371 A1 9/2011 Klein
2011/0247281 A1 10/2011 Pilz et al.
2011/0262720 A1 10/2011 Riebel et al.
2011/0274886 A1 11/2011 Flennert
2011/0302857 A1 12/2011 McClellan et al.
2012/0023846 A1 2/2012 Mattox et al.
2012/0180414 A1 7/2012 Burgess
2012/0247038 A1 10/2012 Black
2012/0266550 A1 10/2012 Naccarato et al.
2012/0297710 A1 11/2012 Klein

(56) References Cited

U.S. PATENT DOCUMENTS

| | | | | |
|---|---|---|---|---|
| 2013/0031856 | A1 | 2/2013 | Pilz et al. | |
| 2013/0118102 | A1 | 5/2013 | Pilz | |
| 2013/0118764 | A1 | 5/2013 | Porter | |
| 2013/0133844 | A1 | 5/2013 | Smart et al. | |
| 2013/0205694 | A1 | 8/2013 | Stahl, Jr. | |
| 2014/0219719 | A1 | 8/2014 | Hensley et al. | |
| 2014/0260017 | A1 | 9/2014 | Noble, III | |
| 2014/0345886 | A1 | 11/2014 | Yano et al. | |
| 2015/0086793 | A1 | 3/2015 | Kreysler et al. | |
| 2015/0135622 | A1 | 5/2015 | Muenzenberger et al. | |
| 2015/0135631 | A1 | 5/2015 | Foerg | |
| 2015/0275506 | A1 | 10/2015 | Klein et al. | |
| 2015/0275507 | A1 | 10/2015 | Klein et al. | |
| 2015/0275510 | A1 | 10/2015 | Klein et al. | |
| 2015/0354210 | A1 | 12/2015 | Stahl, Jr. et al. | |
| 2015/0368898 | A1 | 12/2015 | Stahl, Jr. et al. | |
| 2016/0016381 | A1 | 1/2016 | Celis Marin | |
| 2016/0017598 | A1 | 1/2016 | Klein et al. | |
| 2016/0017599 | A1 | 1/2016 | Klein et al. | |
| 2016/0201893 | A1 | 7/2016 | Ksiezppolski | |
| 2016/0265219 | A1 | 9/2016 | Pilz | |
| 2016/0296775 | A1 | 10/2016 | Pilz et al. | |
| 2016/0340586 | A1* | 11/2016 | Auth | C09K 21/14 |
| 2016/0348357 | A1 | 12/2016 | Smith et al. | |
| 2017/0016227 | A1 | 1/2017 | Klein | |
| 2017/0175386 | A1 | 6/2017 | Pilz | |
| 2017/0232281 | A1* | 8/2017 | Rakic | H02G 3/22 169/43 |
| 2017/0234004 | A1 | 8/2017 | Pilz | |
| 2017/0234010 | A1 | 8/2017 | Klein | |
| 2017/0260741 | A1 | 9/2017 | Ackerman et al. | |
| 2017/0306615 | A1 | 10/2017 | Klein et al. | |
| 2018/0010333 | A1 | 1/2018 | Foerg | |
| 2018/0044913 | A1 | 2/2018 | Klein et al. | |
| 2018/0072922 | A1 | 3/2018 | Canale | |
| 2018/0171624 | A1 | 6/2018 | Klein et al. | |
| 2018/0171646 | A1 | 6/2018 | Stahl et al. | |
| 2018/0195282 | A1 | 7/2018 | Pilz | |
| 2018/0291619 | A1 | 10/2018 | Ackerman et al. | |
| 2018/0347189 | A1 | 12/2018 | Pilz | |
| 2018/0363293 | A1 | 12/2018 | Pilz | |
| 2019/0284799 | A1 | 9/2019 | Förg | |
| 2019/0316350 | A1 | 10/2019 | Pilz et al. | |
| 2019/0323234 | A1 | 10/2019 | Watanabe et al. | |
| 2019/0323347 | A1 | 10/2019 | Hensley et al. | |
| 2019/0330842 | A1 | 10/2019 | Pilz | |
| 2020/0056073 | A1* | 2/2020 | Hulteen | E04B 1/948 |
| 2020/0080666 | A1* | 3/2020 | Rakic | E04B 1/947 |
| 2020/0199867 | A1 | 6/2020 | Ackerman et al. | |
| 2020/0240140 | A1 | 7/2020 | Pilz | |
| 2020/0284030 | A1 | 9/2020 | Pilz | |
| 2020/0308829 | A1 | 10/2020 | Hunsaker | |
| 2020/0340239 | A1 | 10/2020 | Chang | |
| 2020/0340240 | A1 | 10/2020 | Pilz | |
| 2020/0347590 | A1* | 11/2020 | Robinson | E04B 1/6812 |
| 2020/0362551 | A1 | 11/2020 | Klein et al. | |
| 2021/0010257 | A1 | 1/2021 | Klein et al. | |
| 2021/0017761 | A1 | 1/2021 | Klein et al. | |
| 2021/0032927 | A1* | 2/2021 | Brown | E04B 1/948 |
| 2021/0040731 | A1 | 2/2021 | Pilz | |
| 2021/0062502 | A1 | 3/2021 | Archer et al. | |
| 2021/0101319 | A1 | 4/2021 | Klein et al. | |
| 2021/0148112 | A1 | 5/2021 | Klein | |
| 2021/0164222 | A1 | 6/2021 | Pilz | |
| 2021/0189721 | A1 | 6/2021 | Klein et al. | |
| 2021/0254333 | A1 | 8/2021 | Pilz | |
| 2021/0285208 | A1 | 9/2021 | Pilz | |
| 2021/0396004 | A1 | 12/2021 | Pilz | |
| 2022/0010553 | A1 | 1/2022 | Pilz et al. | |
| 2022/0023684 | A1 | 1/2022 | Pilz et al. | |
| 2022/0042303 | A1 | 2/2022 | Pilz | |
| 2022/0098856 | A1 | 3/2022 | Pilz | |
| 2022/0106785 | A1 | 4/2022 | Klein | |
| 2022/0154456 | A1 | 5/2022 | Griffith et al. | |
| 2022/0162851 | A1 | 5/2022 | Pilz | |
| 2022/0259852 | A1 | 8/2022 | Pilz | |
| 2022/0268017 | A1 | 8/2022 | Pilz | |
| 2022/0349177 | A1 | 11/2022 | Pilz | |
| 2023/0114420 | A1 | 4/2023 | Pilz et al. | |
| 2023/0115315 | A1 | 4/2023 | Pilz et al. | |
| 2023/0203807 | A1 | 6/2023 | Pilz et al. | |
| 2023/0220665 | A1 | 7/2023 | Pilz et al. | |
| 2023/0407626 | A1 | 12/2023 | Pilz et al. | |
| 2024/0052629 | A1 | 2/2024 | Pilz et al. | |

FOREIGN PATENT DOCUMENTS

| | | | | |
|---|---|---|---|---|
| CA | 2711659 | | 2/2012 | |
| CA | 2697295 | | 12/2013 | |
| CA | 2736834 | | 12/2015 | |
| CA | 2803439 | | 3/2017 | |
| CA | 3010414 | | 8/2017 | |
| DE | 2645807 | B1 | 3/1978 | |
| DE | 3238236 | A1 * | 4/1984 | E06B 3/9608 |
| DE | 29909381 | U1 * | 8/1999 | E04B 2/7411 |
| DE | 60213279 | T2 | 7/2007 | |
| EP | 0 335 347 | | 10/1989 | |
| EP | 0 346 126 | | 12/1989 | |
| EP | 0509701 | A1 | 10/1992 | |
| EP | 1092815 | A1 * | 4/2001 | E04B 2/7411 |
| EP | 2362031 | A2 * | 8/2011 | E04B 2/7411 |
| EP | 3056626 | A1 * | 8/2016 | C09J 7/26 |
| EP | 3 196 376 | | 7/2017 | |
| EP | 3 348 729 | | 7/2018 | |
| EP | 3 556 957 | A1 | 10/2019 | |
| EP | 3584381 | A1 * | 12/2019 | E04B 1/6813 |
| GB | 2 159 051 | | 11/1985 | |
| GB | 2 239 213 | A | 6/1991 | |
| GB | 2275281 | A * | 8/1994 | E04H 9/10 |
| GB | 2 411 212 | | 8/2005 | |
| GB | 2 424 658 | | 10/2006 | |
| GB | 2 494 721 | A | 3/2013 | |
| GB | 2522934 | A * | 8/2015 | A62C 2/065 |
| JP | 03151433 | A * | 6/1991 | |
| JP | 04347238 | A * | 12/1992 | |
| JP | 05125875 | A * | 5/1993 | |
| JP | 05230910 | A * | 9/1993 | |
| JP | 06-042090 | A | 2/1994 | |
| JP | 06057839 | A * | 3/1994 | |
| JP | 06-146433 | | 5/1994 | |
| JP | 06-220934 | | 8/1994 | |
| JP | 07-4620 | U | 1/1995 | |
| KR | 100664665 | B1 | 1/2007 | |
| KR | 101732118 | B1 * | 5/2017 | E04B 1/948 |
| KR | 20190068167 | A | 6/2019 | |
| WO | WO 2003/038206 | | 5/2003 | |
| WO | WO 2004/071584 | | 8/2004 | |
| WO | WO 2007/103331 | | 9/2007 | |
| WO | WO 2009/026464 | | 2/2009 | |
| WO | WO 2013/113734 | | 8/2013 | |
| WO | WO 2017/129398 | | 1/2017 | |
| WO | WO 2019/108295 | | 6/2019 | |

OTHER PUBLICATIONS

U.S. Appl. No. 17/129,511, filed Dec. 21, 2020, Pilz.
U.S. Appl. No. 17/304,451, filed Jun. 21, 2021, Pilz et al.
U.S. Appl. No. 17/305,653, filed Jul. 12, 2021, Pilz et al.
U.S. Appl. No. 17/446,947, filed Sep. 3, 2021, Pilz.
U.S. Appl. No. 17/303,173, filed May 21, 2021, Pilz et al.
Australian Office Action, re AU Application No. 2019213363, dated May 26, 2020.
Australian Office Action, re AU Application No. 2019250152, dated Jul. 10, 2020.
BlazeFrame 2009 catalog of products, available at least as of Mar. 4, 2010 from www.blazeframe.com, in 20 pages.
Canadian First Office Action for Application No. 2,697,295, dated Sep. 21, 2011, in 4 pages.
Canadian Second Office Action for Application No. 2,697,295, dated May 23, 2012, in 4 pages.
Canadian Office Action for Application No. 2,827,183, dated Mar. 27, 2015 in 4 pages.

(56) References Cited

OTHER PUBLICATIONS

Canadian Office Action for Application No. 2,827, 183, dated Mar. 7, 2016 in 4 pages.
Canadian Office Action for Applicaton No. 2,802,579, dated Jan. 3, 2019 in 3 pages.
Canadian Office Action for Application No. 3,036,429, dated Apr. 8, 2020, in 4 pages.
Canadian Office Action re Application No. 3,052,184, dated Jul. 14, 2021.
Canadian Office Action re Application No. 3,080,978, dated Jun. 17, 2021.
Catalog page from Stockton Products, printed from www.stocktonproducts.com, on Dec. 16, 2007, showing #5 Drip, in 1 page.
ClarkDietrich Building Systems, Product Submittal Sheet, (FTSC) Flat Trail Vertical Slide Clip. Cd- FTSC11 07/11. 1 page.
DoubleTrackTM information sheets by Dietrich Metal Framing, in 2 pages; accessible on Internet Wayback Machine on Jul. 8, 2006.
FireStikTM by CEMCO Brochure, published on www.firestik.us, in 18 pages; accessible on Internet Wayback Machine on Aug. 13, 2007.
Information Disclosure Statement letter; U.S. Appl. No. 12/196,115, dated Aug. 4, 2011.
International Search Report for Application No. PCT/US2008/073920, dated Apr. 9, 2009.
"Intumescent Expansion Joint Seals", Astroflame; http://www.astroflame.com/intumescent_expansion_joint_seals; Jul. 2011; 4 pages.
James A. Klein's Answer, Affirmative Defenses and Counterclaims to Third Amended Complaint; U.S. District Court, Central District of California; Case No. 2:12-cv-10791-DDP-MRWx; Filed Sep. 17, 2014; pp. 1-37.
Letter from Thomas E. Loop; counsel for defendant; Jun. 26, 2015.
Expert Report of James William Jones and exhibits; Case No. CV12-10791 DDP (MRWx); May 18, 2015.
Letter from Ann G. Schoen of Frost Brown Todd, LLC; Jun. 24, 2015.
"System No. HW-D-0607", May 6, 2010, Metacaulk, www.rectorseal.com, www.metacault.com; 2008 Underwriters Laboratories Inc.; 2 pages.
Trim-Tex, Inc., TRIM-TEX Wall Mounted Deflection Bead Installation Instructions, 2 pages. [Undated. Applicant requests that the Examiner review and consider the reference as prior art for the purpose of examination.].
"Wall Mounted Deflection Bead," Trim-Tex Drywall Products; Oct. 9, 2016; 3 pages.

* cited by examiner

BUILDING JOINT WITH COMPRESSIBLE FIRESTOPPING COMPONENT

CROSS REFERENCE

This application claims the benefit of U.S. App. No. 63/067,583, filed Aug. 19, 2021, and U.S. App. No. 63/110,293, filed Nov. 5, 2020, the entirety of which are hereby incorporated by reference in their entireties.

BACKGROUND

Field

This application is directed toward fire-rated wall construction components for use in building construction.

Related Art

Header tracks, including slotted header tracks, are commonly used in the construction industry as a portion of a wall assembly. A typical header track resembles a generally U-shaped (or some other similarly shaped) elongated channel capable of receiving or covering the ends of wall studs and holding the wall studs in place. The header track also permits the wall assembly to be coupled to an upper horizontal support structure, such as a ceiling, floor of a higher level floor of a multi-level building, or a support beam.

Header tracks generally have a web and at least one flange extending from the web. Typically, the header track includes a pair of flanges, which extend in the same direction from opposing edges of the web. Along the flanges of the slotted tracks generally is a plurality of slots. When the wall studs are placed into a slotted track, the plurality of slots accommodates fasteners to permit attachment of the wall studs to the slotted track. The slots allow the wall studs to move generally orthogonally relative to the track. In those areas of the world where earthquakes are common, movement of the wall studs is important. If the wall studs are rigidly attached to the slotted track and not allowed to move freely in at least one direction, the stability of the wall and the building might be compromised. With the plurality of slots, the wall studs are free to move. Even in locations in which earthquakes are not common, movement between the studs and the header track can be desirable to accommodate movement of the building structure due to other loads, such as stationary or moving overhead loads, for example.

Fire-rated wall construction components and assemblies are also commonly used in the construction industry. These components and assemblies are aimed at preventing fire, heat, and smoke from leaving one portion of a building or room and entering another, usually through vents, joints in walls, or other openings. The components often incorporate fire-retardant materials which substantially block the path of the fire, heat, or smoke for at least some period of time. Intumescent materials work well for this purpose, since they swell and char when exposed to flames, helping to create a barrier to the fire, heat, and/or smoke.

One example of a fire-rated wall construction component is a head-of-wall fire block device sold under the trademark FIRESTIK®. The FIRESTIK® fire block product incorporates a metal profile with a layer of intumescent material on its inner surface. The metal profile of the FIRESTIK® fire block product is independently and rigidly attached to a wall component, such as the bottom of a floor or ceiling, and placed adjacent to the gap between the wallboard (e.g., drywall) and the ceiling. The intumescent material, which is adhered to the inner surface of the metal profile, faces the wallboard, stud and header track. The space created in between the wallboard and ceiling, and the space between the stud and header track, allows for independent vertical movement of the stud in the header track when no fire is present. When temperatures rise, the intumescent material on the FIRESTIK® fire block product expands rapidly. This expansion creates a barrier which fills the head-of-wall gap and substantially inhibits or at least substantially prevents fire, heat, and smoke from moving through the spaces around the stud and track and entering an adjacent room for at least some period of time.

Some fire-retardant wall systems include a header track that incorporates a fire-retardant material directly on the header track. For example, a header track sold by California Expanded Metal Products Company d/b/a CEMCO, the assignee of the present application, under the trade name FAS TRACK® includes intumescent material applied to the header track. Preferably, the track is configured to at least substantially prevent the passage of air through a head-of-wall gap in conditions prior to any expansion of a heat-activated expandable fire-retardant material or prior to complete expansion or expansion of the heat-activated expandable fire-retardant material sufficient enough to close the head-of-wall gap.

SUMMARY

In some arrangements, a wall assembly includes a compressible component positioned within a deflection gap between an upper edge of the wallboard and a ceiling or other horizontal structural element. The compressible component can include an intumescent strip. The intumescent strip can be placed in contact with the ceiling or the upper edge of the wallboard. The compressible component can be held in place by a double-sided tape attached with the header track, the ceiling, or the upper edge of the wallboard. The double-sided tape can partially cover one side of the compressible component.

According to a first embodiment, a head of wall assembly includes an overhead structure, a header track attached with the overhead structure, the header track including a first flange and a second flange coupled with a web. At least one stud attaches with the header track and having an upper end received between the first and second flanges. A wallboard attaches with the at least one stud. A deflection gap is disposed between an upper end of the wallboard and the overhead structure. An elongate, compressible firestopping component is received within the deflection gap to block the passage of fire, heat, smoke and/or sound, through the deflection gap.

The elongate, compressible firestopping component has a first end and a second end. A compressible foam material has a rectangular cross-sectional profile and includes a first side and a second side meeting at a corner, a third side opposite the second side, and a fourth side opposite the first side. The rectangular cross-sectional profile extending from the first end to the second end. The first side including an intumescent strip having a first width, the first width extending from a first edge to a second edge, the first edge of the intumescent strip aligned with the corner. The second side includes a first portion covered by a factory-applied double-sided tape layer and a second uncovered portion, the double-sided tape layer having a second width. The second width extends from a first edge to a second edge. The first edge of the double-sided tape layer aligns with the corner.

The first width of the intumescent layer is greater than 50% of a width of the compressible foam material. The second width of the double-sided tape layer is less than 50% of a height of the compressible foam material. A first face of the double-sided tape layer is attached with the second side of the compressible foam material, a second face of the double-sided tape layer is attached with an outer surface of the first flange of the header track, and the second uncovered portion of the second side contacts the outer surface of the first flange. The intumescent layer contacts the overhead structure. The fourth side of the compressible foam material contacts the upper edge of the wallboard. The double-sided tape layer comprises a polypropylene backing material and a tackified acrylic adhesive.

According to another embodiment, a head of wall assembly has an overhead structure, a header track attached with the overhead structure, the header track including a first flange and a second flange coupled with a web, at least one stud attached with the header track and having an upper end received between the first and second flanges, and a wallboard attached with the at least one stud. A deflection gap is disposed between an upper end of the wallboard and the overhead structure.

An elongate, compressible firestopping component is received within the deflection gap to block the passage of fire, heat, smoke and/or sound, through the deflection gap. The elongate compressible firestopping component has a first end and a second end. A compressible foam material has a cross-sectional profile including a first side and a second side. The cross-sectional profile extends from the first end to the second end. The first side includes an intumescent strip with a first width. The first width extending from a first edge to a second edge of the intumescent strip. The second side includes a first portion covered by a factory-applied double-sided tape layer and a second uncovered portion, the double-sided tape layer having a second width. The second width extends from a first edge to a second edge of the double-sided tape layer. A first face of the double-sided tape layer is attached with the second side of the compressible foam material and a second face of the double-sided tape layer is opposite the first layer.

According to another aspect, the cross-sectional profile of the compressible foam material comprises a rectangular cross-sectional profile having the first and second side and further including a third side and a fourth side. According to another aspect, the first and second side meet at a corner, the fourth side is opposite the first side, and the third side opposite the second side. According to another aspect, the first edge of the intumescent strip aligns with the corner. According to another aspect, the first edge of the intumescent strip is spaced from the corner. According to another aspect, the first edge of the double-sided tape layer is aligned with the corner. According to another aspect, the first edge of the double-sided tape layer is spaced from the corner. According to another aspect, the first width of the intumescent layer is greater than 50% of a length of the first side of the compressible foam material. According to another aspect, the second width of the double-sided tape layer is less than 50% of a length of the second side of the compressible foam material. According to another aspect, the second width of the double-sided tape layer is greater than 50% of a length of the second side of the compressible foam material. According to another aspect, the second face of the double-sided tape layer is attached with an outer surface of the first flange of the header track and the second uncovered portion of the second side faces the outer surface of the first flange. According to another aspect, a second double-sided tape layer attaches between the fourth side of the compressible material and the upper edge of the wallboard. According to another aspect, the intumescent layer is disposed between the ceiling and the first side of the compressible material. According to another aspect, the second face of the double-sided tape layer is attached with the upper end of the wallboard and the second uncovered portion of the second side faces the upper end of the wallboard. According to another aspect, the second face of the double-sided tape layer is attached with the overhead structure, the second uncovered portion of the second side faces the overhead structure, and the intumescent layer contacts the upper end of the wallboard. According to another aspect, a second double-sided tape layer attaches between the fourth side of the compressible material and an outer surface of the first flange of the header track. According to another aspect, the double-sided tape layer comprises a polypropylene backing material. According to another aspect, the double-sided tape layer comprises a tackified acrylic adhesive.

According to another embodiment, a head of wall assembly has an overhead structure, a header track attached with the overhead structure, the header track including a first flange and a second flange coupled with a web, at least one stud attached with the header track and having an upper end received between the first and second flanges, and a wallboard attached with the at least one stud. A deflection gap is disposed between an upper end of the wallboard and the overhead structure.

An elongate, compressible firestopping component is received within the deflection gap to block the passage of fire, heat, smoke and/or sound, through the deflection gap. The elongate, compressible firestopping component has a first end and a second end. A compressible foam material has a cross-sectional profile including a first side. The cross-sectional profile extending from the first end to the second end. The first side includes an intumescent strip having a first width, the first width extending from a first edge to a second edge of the intumescent strip. A factory-applied double-sided tape layer attaches with the intumescent strip. The double-sided tape layer has a second width extending from a first edge to a second edge of the double-sided tape layer.

According to another aspect, a first face of the double-sided tape layer is attached with the second side of the compressible foam material and a second face of the double-sided tape layer is attached with the overhead structure. According to another aspect, a first face of the double-sided tape layer is attached with the second side of the compressible foam material and a second face of the double-sided tape layer is attached with the upper end of the wallboard. According to another aspect, the cross-sectional profile of the compressible foam material comprises a rectangular cross-sectional profile. According to another aspect, a first edge of the intumescent strip aligns with a corner of the compressible material. According to another aspect, a first edge of the intumescent strip is spaced from a corner of the compressible material. According to another aspect, the first edge of the intumescent strip is aligned with the first edge of the double-sided tape. According to another aspect, the first width of the intumescent layer partially covers the first side of the compressible foam material. According to another aspect, the first width of the intumescent layer is less than 50% of a length of the first side of the compressible foam material. According to another aspect, the first width is equal to the second width. According to another aspect, a second double-sided tape layer attaches between a second side of the compressible material and an outer surface of the first flange of the header track.

The foregoing summary is illustrative only and is not intended to be limiting. Other aspects, features, and advantages of the systems, devices, and methods and/or other subject matter described in this application will become apparent in the teachings set forth below. The summary is provided to introduce a selection of some of the concepts of this disclosure. The summary is not intended to identify key or essential features of any subject matter described herein

DETAILED DESCRIPTION

Figure 1:
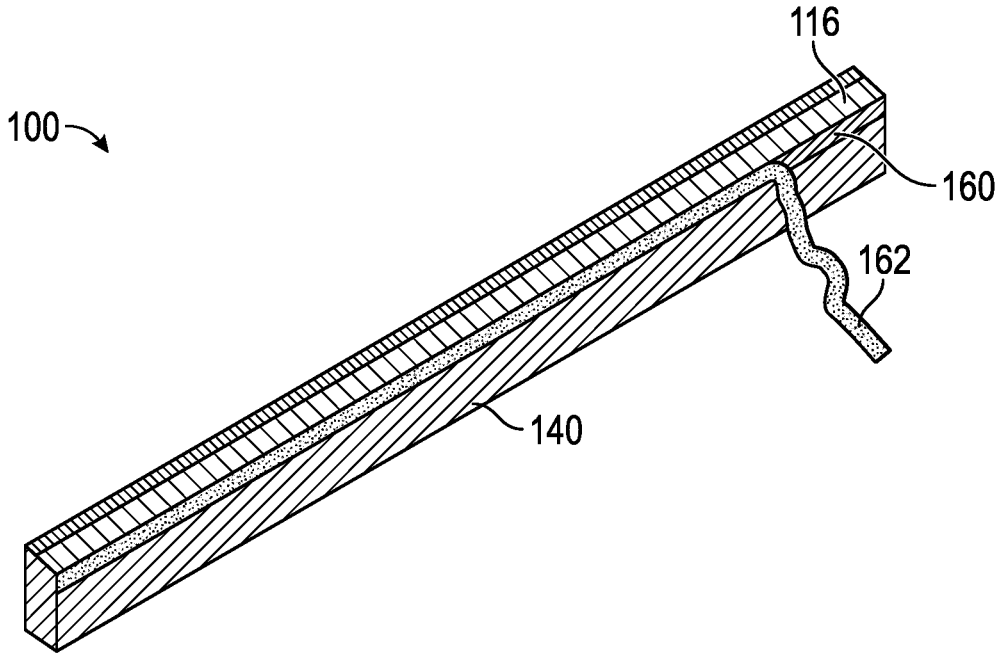
FIG. 1 shows a first compressible firestopping component with an intumescent strip layer, a double-sided tape layer and a partially removed release sheet.

Several embodiments of an improved fire-rated wall system 10 and individual components of the wall system 10 are disclosed herein. The embodiments disclosed herein often are described in the context of a wall system 10 for use in the interior of a building and configured for preventing passage of smoke and/or fire between adjacent rooms in an elevated-temperature environment. The system 10 can include, for example, a metal header track and at least one metal stud nested within the track, with at least one layer of fire-retardant material applied on the header track. However, the embodiments herein can be applied to wall systems configured for other types of environments as well, such as for exterior wall applications, and can include different and/or additional components and types of materials other than those described herein.

For the purpose of providing context to the present disclosure, it is noted that in 2006 a revision was made to Underwriters Laboratory UL 2079 "Test for Fire Resistance of Building Joints". The revision recommended a new test to determine the amount of air or smoke that can pass through a wall joint (e.g. the area or gap generally between the top of a wallboard and a ceiling component in a fire rated framed wall) in both an ambient condition, as well as at 400 degrees Fahrenheit (F.). It had been determined that smoke is as dangerous, or more dangerous, than flames in a fire event. Thus, there was a desire to begin testing for movement of smoke through wall joints. Specifically, there was a desire to test for two vulnerable points or locations in a wall assembly where air or smoke can pass from one room to another. The first of these points or locations is at the intersection between the top header track and the ceiling element (e.g., the ceiling deck or floor deck of the floor above). The second point or location is at the intersection between the header track and the drywall, where a deflection gap is often located. Maintaining a consistent air tight seal of these two points or locations is thus required for passing all components of the UL 2079 test.

However, the UL 2079 test has proven to be problematic for some building components because of certain characteristics of current building products and assembly methods. For example, drywall gypsum board is the most common product used in fire rated framed walls. The typical size for drywall gypsum board is 4'×8' sheets. The drywall can lay relatively flat when up against a flat substrate (e.g., a framed wall). However, if there is any type of protrusion in the substrate, that protrusion can transfer through the drywall, creating a hump or a gap on the other side of the drywall. If the protrusion is around the perimeter of the sheet of drywall, the protrusion can often create a separation gap between the framed wall substrate and the edge of the drywall.

As described above, metal stud framing (e.g. use of a header and/or footer track to hold metal studs) is a very common component of fire-rated framed wall construction. This type of framing can consist of a U-shaped or generally U-shaped track to receive a C-shaped or generally C-shaped stud. The tracks are generally placed along both a floor and a ceiling element, with studs nested into the tracks, one end of each stud nested in a track along the floor, and the other end of each stud nested in a track along the ceiling. In order for the stud to nest into the track, the outside dimension of the stud can be the same as the inside dimension of the track. However, by virtue of the thickness of the steel forming a track, this can often create a slight offset between the track and the drywall, because the drywall can extend along both the track and the stud extending below or above the track. Furthermore, a fastening screw is often used to attach the stud to the track (e.g., through a slot to allow movement between the stud and the track). This additional protrusion or obstacle, combined with the offset described above, can for example create up to a ⅛" or greater gap between portions the framed wall and the sheet of drywall. Accordingly, one or more embodiments disclosed herein provide fire and/or smoke protection elements across the deflection gap. In at least some implementations, these embodiments can be completely or at least partially installed during the wall framing process without the need for additional sealant.

Compressible firestopping foam has been used for fire-rated building joints and tested per UL-2079 "Standard for Tests for Fire Resistance of Building Joint Systems" since 2016, such the foam materials described in U.S. Pat. No. 10,184,246. Previously available products, such as CEMCO HOTROD and RECTORSEAL BLAZEFOAM, include rectangular, compressible foam firestopping components that are installed within a building joint (e.g., within the deflection gap).

In a building joint, such compressible firestopping components is positioned between an upper edge of the drywall and the ceiling or other overhead structure. Ideally, the width of the deflection gap is between ½" and ¾". However, many drywall installers do not pay close attention to the gap width at the top of the drywall. Often, the gap in the joint is very small (e.g., less than ½"), making it difficult (e.g., time consuming or labor intensive) to install the firestopping component. Depending on the width of the deflection joint, the firestopping component can be easy or difficult to install.

For example, it may be difficult to stuff a compressible material within a very small deflection gap.

One remedy to avoid potentially troublesome installation is to pre-install the compressible firestopping component prior to installing the drywall. To this end, the firestopping component can include a factory-applied double-sided tape layer. The double-sided tape layer can be attached on one side of the compressible firestopping component. The double-sided tape layer can include a release sheet that can be removed before the compressible firestopping component is installed within the wall assembly. The double-sided tape layer can pre-attach the compressible firestopping component with a face of the framing member, the ceiling, or an upper edge of the wallboard. The wallboard can then be installed by attached with the studs. The compressible firestopping component can be compressed within the deflection gap as the wallboard is moved into the assembled position, thus eliminating the need to manually compress the compressible firestopping component after installing the wallboard (e.g., regardless of the size of the deflection gap). The pre-installation of the compressible firestopping component can accordingly speed up the installation process for the head of wall assembly and reduce or eliminate gaps through the deflection gap that would allow passage of fire, smoke or sound.

Figure 2:
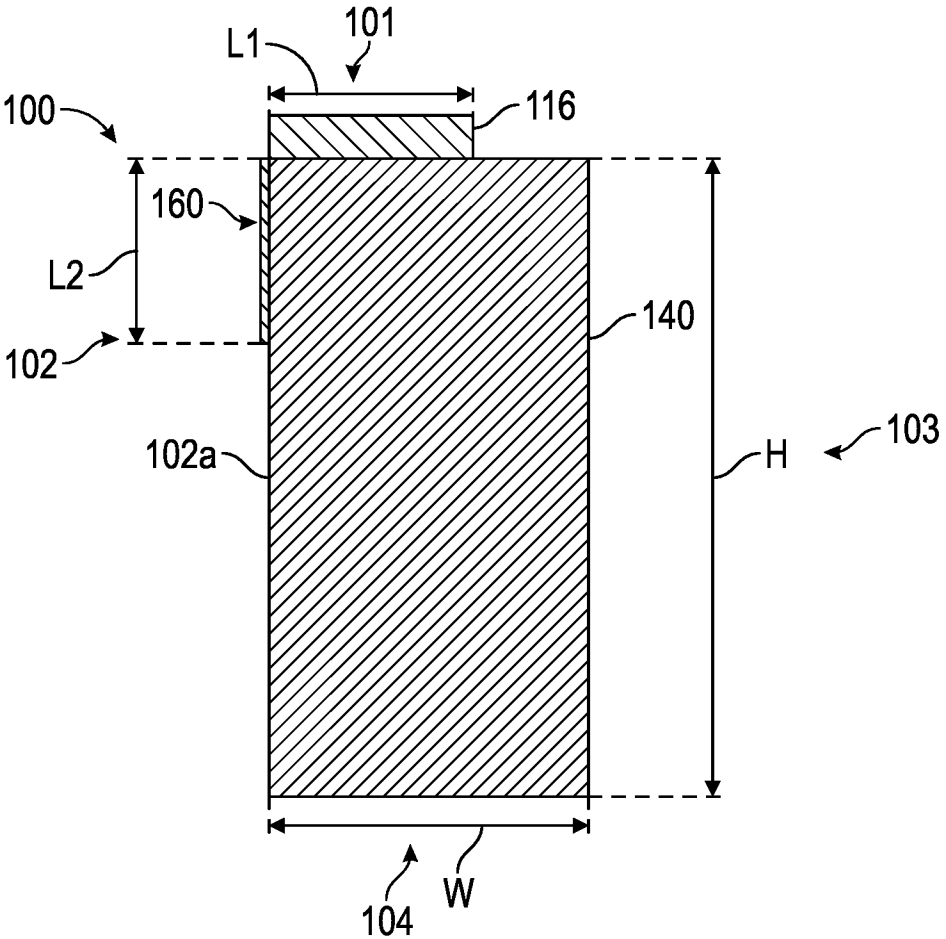
FIG. 2 shows a cross-section of the first compressible firestopping component.

FIGS. 1-2 shows a first compressible firestopping component 100. The compressible firestopping component 100 can be sold in standard length (e.g., 10 or 12 feet) and/or in packages containing multiple compressible firestopping components. The compressible firestopping component 100 can include an elongate foam body or foam portion 140. The foam portion 140 can comprise an open or closed cell foam, such as an open cell polyurethane foam material. The foam portion 140 can be at least somewhat compressible to accommodate movement of a head-of-wall deflection gap and/or uneven surfaces within the deflection gap. Preferably, the foam portion 140 can be compressed to at least about a 50%, 60% or 70% and up to about an 80% reduction in cross-sectional thickness, including a range encompassing those values or any value within such a range. In some cases, the foam portion 140 may be compressible to somewhat more than 80% of its original cross-sectional dimension or thickness.

The foam portion 140 can include or define a cross-sectional profile. The shape of the cross-sectional profile can be rectangular, square, circular, oval, elliptical, triangular, half circular, or other possible profile shapes. The shape of the cross-sectional profile can be uniform from a first end to a second end of the firestopping component 100. Preferably, foam portion 140 substantially fills the deflection gap. Accordingly, the foam portion 140 preferably has a cross-sectional dimension (e.g., diameter) that is equal or relatively close to the nominal deflection gap, which can be defined as a linear, vertical distance between an upper edge of a wallboard and the ceiling when the wallboard is at a midpoint in its available range of vertical movement. Preferably, some amount of compression of the foam portion 140 occurs when positioned in the deflection gap, such as between about 10% and 40% or any value or sub-range within this range (e.g., 25%).

The foam portion 140 can include a top side or a first side 101, an inner side or second side 102, an outer or third side 103, and/or a lower or fourth side 104. The first through fourth sides can form a rectangular cross sectional profile of the foam portion 140. The first and second sides can meet at a first corner, the second and fourth sides can meet at a second corner, the third and fourth sides can meet at a third corner, and the first and fourth sides can meet at a fourth corner. One or all of the first through fourth sides can be planer. One or all of the first through fourth sides can be orthogonal with the adjacent sides. The foam portion 140 can have a height H and a width W.

The firestopping component 100 can include a sealing portion, sealing element or intumescent layer 116. The intumescent layer 116 can be positioned on one or more sides of the foam portion 140. As shown, the intumescent layer 116 is positioned along the upper or first side 101 of the foam portion 140. The intumescent layer 116 may comprise a flexible adhesive sealant. In some configurations, the intumescent layer 116 may additionally or alternatively comprise or be a fire-resistant or intumescent material that expands under elevated temperatures ("an intumescent layer or intumescent strip"). The intumescent layer 116 can be factory or field-applied to the foam portion 140. The intumescent layer 116 can extend from the first to the second end of the firestopping component 100.

The intumescent layer 116 can have a width L1. The width L1 can extend from a first lateral edge to a second lateral edge. The width L1 can be less than or equal to the width W of the first side 101. The intumescent layer 116 can be spaced from the first corner and/or the second corner. The first lateral edge of the intumescent layer 116 can be aligned with the second side 102 at the first corner.

The firestopping component 100 can include a double-sided tape layer 160. The tape layer 160 can be positioned on one or more sides of the foam portion 140. As shown, the tape layer 160 is positioned along the second side 102 of the foam portion 140. The tape layer 160 can cover a first portion of the second side and leave a second portion 102*a* uncovered. As shown, the tape layer 160 covers an upper portion of the inner surface of the foam portion 140. The tape layer 160 can have a width L2. The width L2 can extend from a first lateral edge to a second lateral edge of the tape layer 160. The width L2 can be less than or equal to the height H of the second side 102. Desirably, the width L2 can be less than 50% of the height H. The tape layer 160 can be spaced from the first corner and/or the second corner. The first lateral edge of the tape layer 160 can be aligned with the first side 101 at the first corner.

The tape layer 160 can be TESA 51970 transparent double-sided filmic tape. The tape layer can be strong enough to properly adhere to the surface of the foam portion 140 (e.g., open cell foam) and to the framing member without easily delaminating. The tape layer 160 can include a polypropylene backing material, be transparent in color, have a total thickness of 220 micrometers, use a tackified acrylic adhesive, have a 150% elongation break point, a tensile strength of 50 N/cm, a glassine liner and/or a liner thickness of 71 micrometers.

The tape layer 160 can include a removable liner or release sheet 162. The release sheet 162 can comprise a paper, plastic or other material. Tearing away the release sheet 162 can expose an adhesive surface of the tape layer 160. The tape layer 160 can extend from end-to-end of the firestopping component 100.

Figure 3:
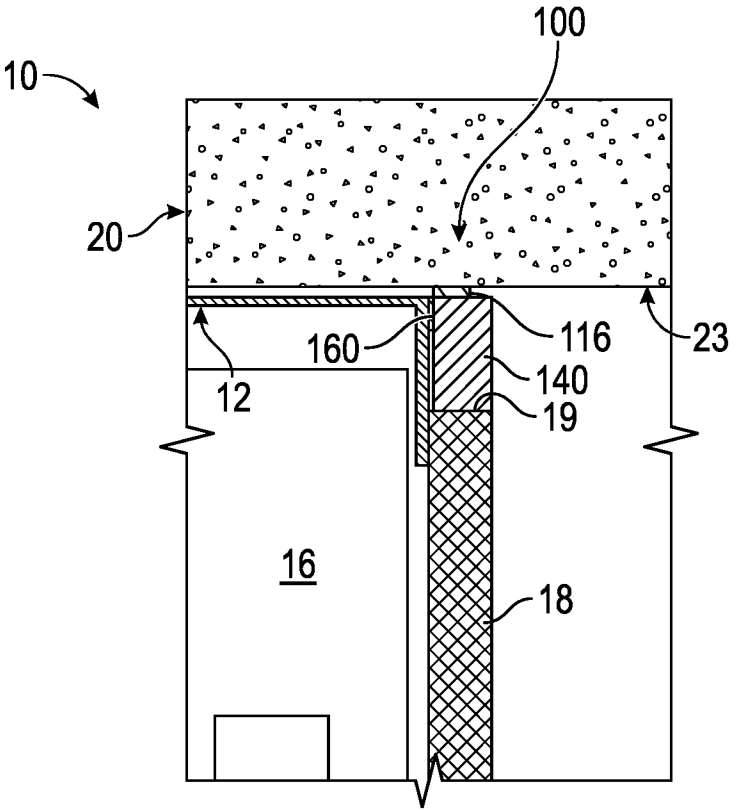
FIG. 3 shows a cross-section of the compressible firestopping component within a head of wall assembly.

FIG. 3 shows the firestopping component 100 installed within an exemplary stud-framed wall assembly 10, similar to the wall assembly 10 in U.S. Pat. No. 10,184,246. The wall assembly 10 can include a ceiling 20, a header track 12 coupled with the ceiling 20, at least one stud 16 coupled with the header track 12 and at least one wallboard 18 coupled with the stud 16. The wall assembly 10 can include a deflection gap between an upper edge 19 of the wallboard 18 and a lower face 23 of the ceiling 20. The firestopping component 100 can be installed within the deflection gap and extend along the upper edge of the wallboard 18. The firestopping component 100 can accordingly inhibit or prevent the passage of fire, heat, smoke and/or sound from leaving one portion of a building or room and entering another through the deflection gap. (or another type joint, depending on installation of the firestopping component 100).

The firestopping component 100 can be installed after framing the header track 12 and the stud 16, but before installation of the wallboard 18. To install the firestopping component 100, the release sheet 162 can be removed from the tape layer 160. The release sheet 162 can removed just prior to installing the firestopping component 100 against the framing member within the building joint. The tape layer 160 can then be adhered to an outer surface of a flange of the header track 12, as illustrated. The intumescent strip can abut the lower surface 23 of the ceiling 20. The wallboard 18 can then be installed on the stud 16. In one example, the wallboard 18 can be installed by sliding the upper edge 19 upwards along the stud 16 and against the lower or fourth side 104 of the firestopping component 100. This can ensure the firestopping component 100 contacts the upper edge 19 of the wallboard 18. The wallboard 18 can also compress the firestopping component 100 within the deflection gap (e.g., between the upper edge of the drywall and the bottom 23 of the ceiling 20). This installation can eliminate the need to compress the foam portion 140 before insertion into the deflection gap.

In the installed position, the tape layer 160 can be positioned on an interior side of the firestopping component 100. The tape layer 160 can be between the second side 102 of the foam portion 140 and the header track 12. The uncovered second portion 102*a* of the second side 102 can contact the flange of the header track 12. The sealant layer/intumescent layer 116 can be positioned between the first side 101 of the foam portion 140 and the bottom surface 23 of the ceiling 20.

Figure 5:
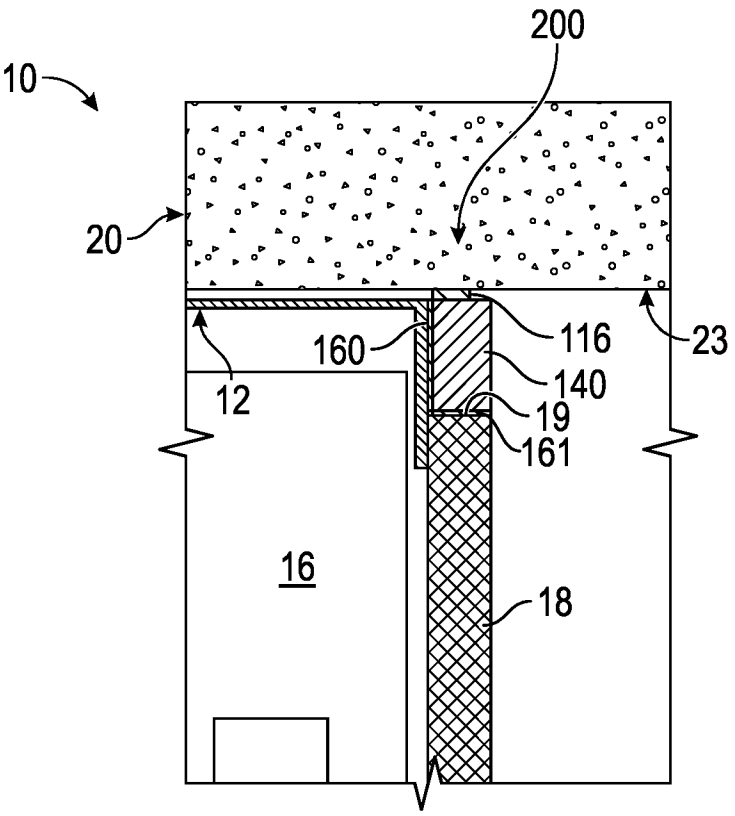
FIG. 5 shows a cross-section of the second compressible firestopping component within a head of wall assembly.
Figure 4:
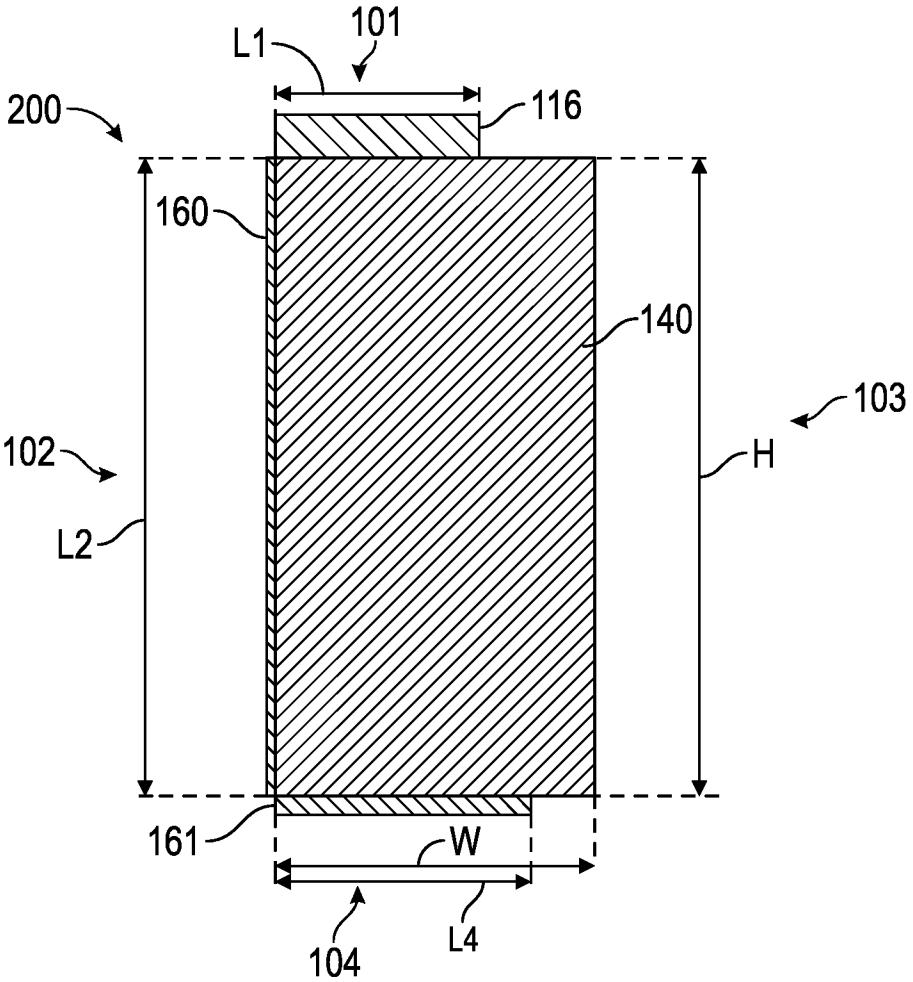
FIG. 4 shows a cross-section of a second compressible firestopping component.

FIGS. 4-5 shows a second compressible firestopping component 200 having the same structure as the component 100, but with the differences noted below. The compressible firestopping component 200 can include the elongate foam body or foam portion 140. The foam portion 140 can include or define a cross-sectional profile. The foam portion 140 can include the top side or the first side 101, the inner side or second side 102, the outer or third side 103, and/or the lower or fourth side 104. The foam portion 140 can have the height H and the width W.

The firestopping component 200 can include the sealing portion, sealing element or intumescent layer 116. The intumescent layer 116 can be positioned on one or more sides of the foam portion 140. As shown, the intumescent layer 116 is positioned along the upper or first side 101 of the foam portion 140. The intumescent layer 116 may comprise a flexible adhesive sealant. In some configurations, the intumescent layer 116 may additionally or alternatively comprise or be a fire-resistant or intumescent material that expands under elevated temperatures ("an intumescent layer or intumescent strip"). The intumescent layer 116 can be factory or field-applied to the foam portion 140. The intumescent layer 116 can extend from the first to the second end of the firestopping component 200.

The intumescent layer 116 can have a width L1. The width L1 can extend from a first lateral edge to a second lateral edge. The width L1 can be less than or equal to the width W of the first side 101. The intumescent layer 116 can be spaced from the first corner and/or the second corner. The first lateral edge of the intumescent layer 116 can be aligned with the second side 102 at the first corner.

The firestopping component 200 can include the double-sided tape layer 160. The tape layer 160 can be positioned on one or more sides of the foam portion 140. As shown, the tape layer 160 is positioned along the second side 102 of the foam portion 140. The tape layer 160 can cover a first portion of the second side and leave a second portion 102*a* uncovered. As shown, the tape layer 160 covers the second side 102 of the foam portion 140. The tape layer 160 can have a width L2. The width L2 can extend from a first lateral edge to a second lateral edge of the tape layer 160. The width L2 can be less than or equal to the height H of the second side 102. Desirably, the width L2 can be less than 50% of the height H. The tape layer 160 can be spaced from the first corner and/or the second corner. The first lateral edge of the tape layer 160 can be aligned with the first side 101 at the first corner or at the second corner.

The firestopping component 200 can include a second double-sided tape layer 161. The tape layer 161 can be positioned on one or more sides of the foam portion 140. As shown, the tape layer 161 is positioned along the fourth side 104 of the foam portion 140. The tape layer 161 can cover a first portion of the fourth side and leave a second portion uncovered. The tape layer 161 can have a width L4. The width L4 can extend from a first lateral edge to a second lateral edge of the tape layer 161. The width L4 can be less than or equal to the width W of the fourth side 104. Desirably, the width L4 can be less than 50% of the width W. The tape layer 161 can be spaced from or aligned with one or both corners on the fourth side 104. The second double-sided tape layer 161 can include a release sheet (not shown).

FIG. 5 shows the firestopping component 200 installed within a deflection gap of the exemplary stud-framed wall assembly 10. The firestopping component 200 can be installed according to one or two alternatives. In a first alternative, the component 200 can be attached with the wallboard 18 at the upper surface 19 by the second tape layer 161 after framing the header track 12 and the stud 16, but before installation of the wallboard 18. To install the firestopping component 200, the release sheet can be removed from the tape layer 161. The tape layer 161 can then be adhered to upper surface 19, as illustrated. The wallboard 18 can then be installed on the stud 16. In one example, the wallboard 18 can be installed by sliding the upper edge 19 and the component 200 upwards to abut the intumescent strip 116 against the lower surface 23 of the ceiling 20. This can ensure the firestopping component 100 contacts the lower surface 23. The release sheet of the tape layer 160 can also be removed to attach with the flange of the header track 12. The wallboard 18 can also compress the firestopping component 200 within the deflection gap (e.g., between the upper edge of the drywall and the bottom 23 of the ceiling 20). This installation can eliminate the need to compress the foam portion 140 before insertion into the deflection gap.

In the second alternative, the release sheet 162 can be removed from the tape layer 160. The tape layer 160 can then be adhered to the outer surface of a flange of the header track 12, as illustrated. The intumescent strip 116 can abut the lower surface 23 of the ceiling 20. The wallboard 18 can then be installed on the stud 16. In one example, the wallboard 18 can be installed by sliding the upper edge 19 upwards along the stud 16 and against the second tape layer 161 on the fourth side 104 of the firestopping component 200. This can ensure the firestopping component 200 contacts the upper edge 19 of the wallboard 18. The wallboard 18 can also compress the firestopping component 100 within the deflection gap (e.g., between the upper edge of the drywall and the bottom 23 of the ceiling 20).

In the installed position, the tape layer 160 can be positioned on an interior side of the firestopping component 100. The tape layer 160 can be between the second side 102 of the foam portion 140 and the header track 12. The tape layer 161 can be between the fourth side 104 of the foam portion 140 and the wallboard 18. The sealant layer/intumescent layer 116 can be positioned between the first side 101 of the foam portion 140 and the bottom surface 23 of the ceiling 20.

Figure 7:
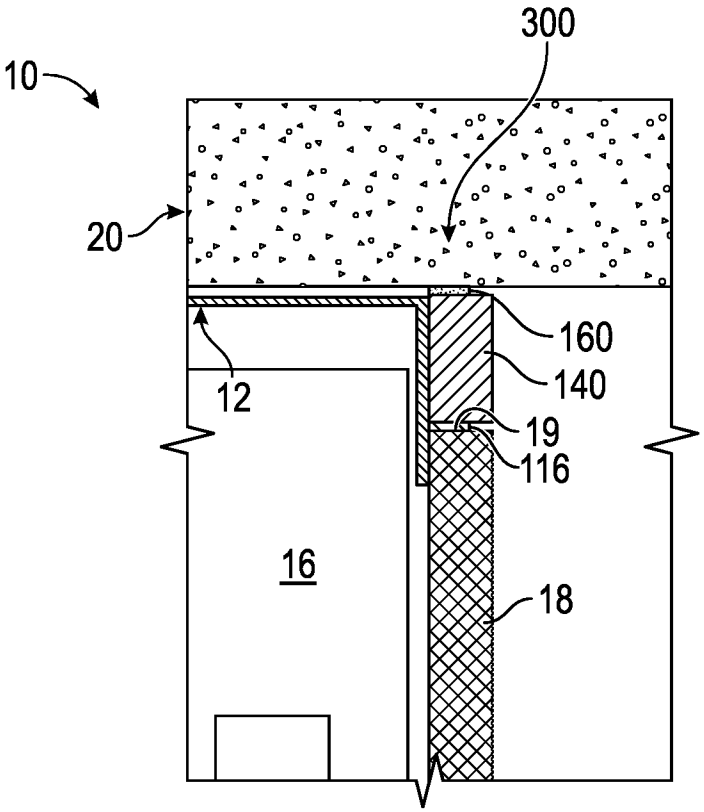
FIG. 7 shows a cross-section of the third compressible firestopping component within a head of wall assembly.
Figure 6:
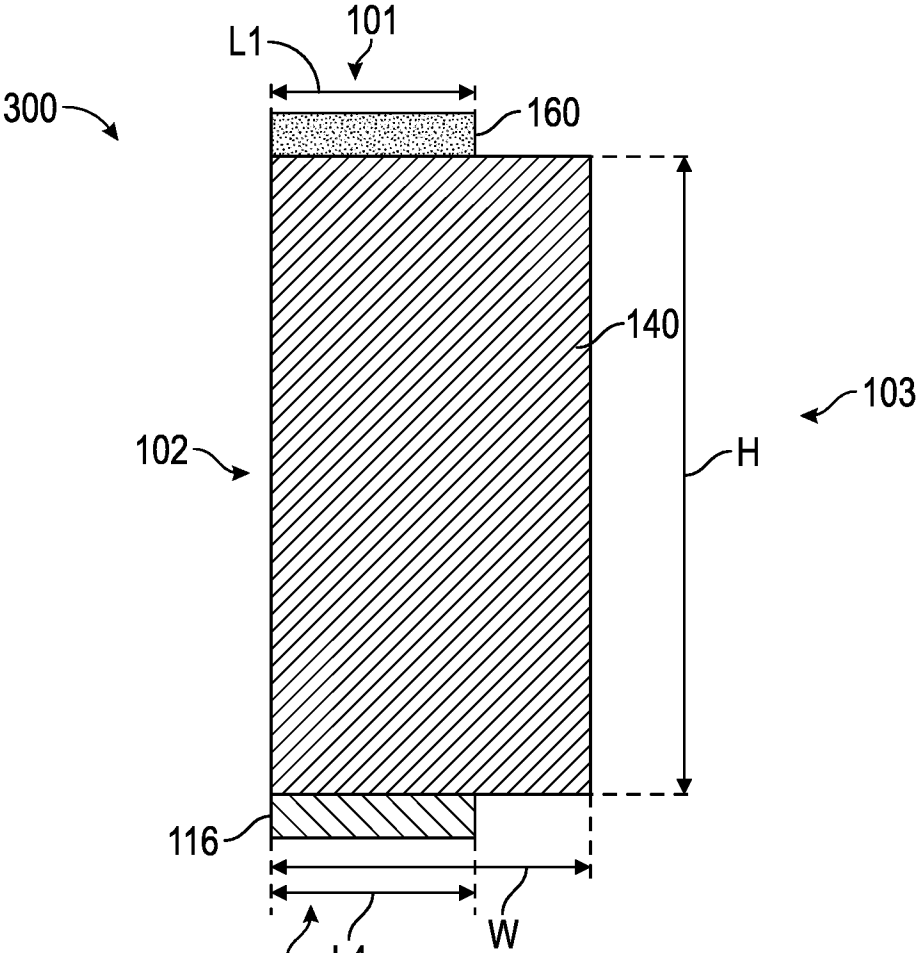
FIG. 6 shows a cross-section of a third compressible firestopping component.

FIGS. 6-7 shows a third compressible firestopping component 300 having the same structure as the component 100, but with the differences noted below. The compressible firestopping component 300 can include the elongate foam body or foam portion 140. The foam portion 140 can include or define a cross-sectional profile. The foam portion 140 can include the top side or the first side 101, the inner side or second side 102, the outer or third side 103, and/or the lower or fourth side 104. The foam portion 140 can have the height H and the width W.

The firestopping component 300 can include the sealing portion, sealing element or intumescent layer 116. The intumescent layer 116 can be positioned on one or more sides of the foam portion 140. As shown, the intumescent layer 116 is positioned along the lower or fourth side 104 of the foam portion 140. The intumescent layer 116 may comprise a flexible adhesive sealant. In some configurations, the intumescent layer 116 may additionally or alternatively comprise or be a fire-resistant or intumescent material that expands under elevated temperatures.

The intumescent layer 116 can have a width L4. The width L4 can extend from a first lateral edge to a second lateral edge. The width L4 can be less than or equal to the width W of the fourth side 104. The intumescent layer 116 can be spaced from or aligned with the corners of the fourth side 104.

The firestopping component 300 can include a double-sided tape layer 160. The tape layer 160 can be positioned on one or more sides of the foam portion 140. As shown, the tape layer 160 is positioned along the first side 101 of the foam portion 140. The tape layer 160 can cover a first portion of the first side 101 and leave a second portion uncovered. The tape layer 160 can have a width L1. The width L1 can extend from a first lateral edge to a second lateral edge of the tape layer 160. The width L1 can be less than or equal to the width W of the first side 101. Desirably, the width L1 can be less than 50% of the width W. The tape layer 160 can be spaced from or aligned with one or both corners on the first side 101. The double-sided tape layer 160 can include a release sheet (not shown).

By placing the tape layer 160 on the opposite side of the foam portion 140 as the sealing layer 116, the tape layer 160 and the sealing layer 116 can be applied more efficiently during manufacturing. Specifically, the tape layer 160 and the tape layer 160 and the sealing layer 116 can be applied simultaneously to the foam portion 140 during manufacture. Furthermore, placing the tape layer 160 on the opposite side of the foam portion 140 as the sealing layer 116, the firestopping component 300 to be packaged in a roll, which may include compression of the foam portion 140. In contrast, if one layer is running in one direction and another layer runs in a perpendicular direction, the resulting component would not be able to be rolled (i.e., without damage).

FIG. 7 shows the firestopping component 300 installed within a deflection gap of the exemplary stud-framed wall assembly 10. The component 300 can be attached with the ceiling 20 at the lower surface 23 by the tape layer 160 after framing the header track 12 and the stud 16, but before installation of the wallboard 18. To install the firestopping component 300, the release sheet can be removed from the tape layer 160. The tape layer 160 can then be adhered to lower surface 23, as illustrated. The wallboard 18 can then be installed on the stud 16. In one example, the wallboard 18 can be installed by sliding the upper edge 19 and the component 300 upwards to abut the intumescent strip 116. This can ensure the firestopping component 100 blocks across the deflection gap. The wallboard 18 can also compress the firestopping component 300 within the deflection gap (e.g., between the upper edge of the drywall and the bottom 23 of the ceiling 20). This installation can eliminate the need to compress the foam portion 140 before insertion into the deflection gap.

Figure 9:
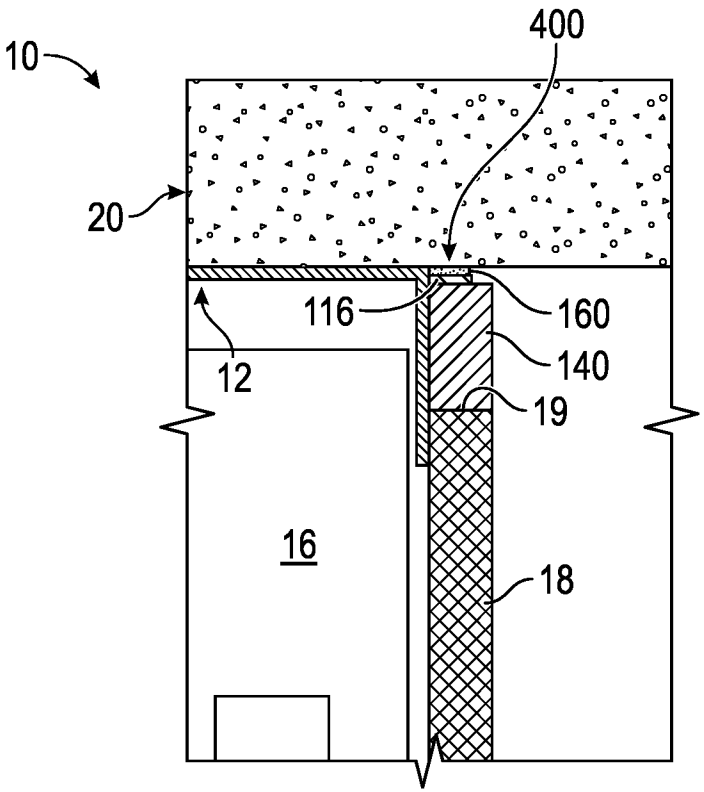
FIG. 9 shows a cross-section of the fourth compressible firestopping component within a head of wall assembly.
Figure 8:
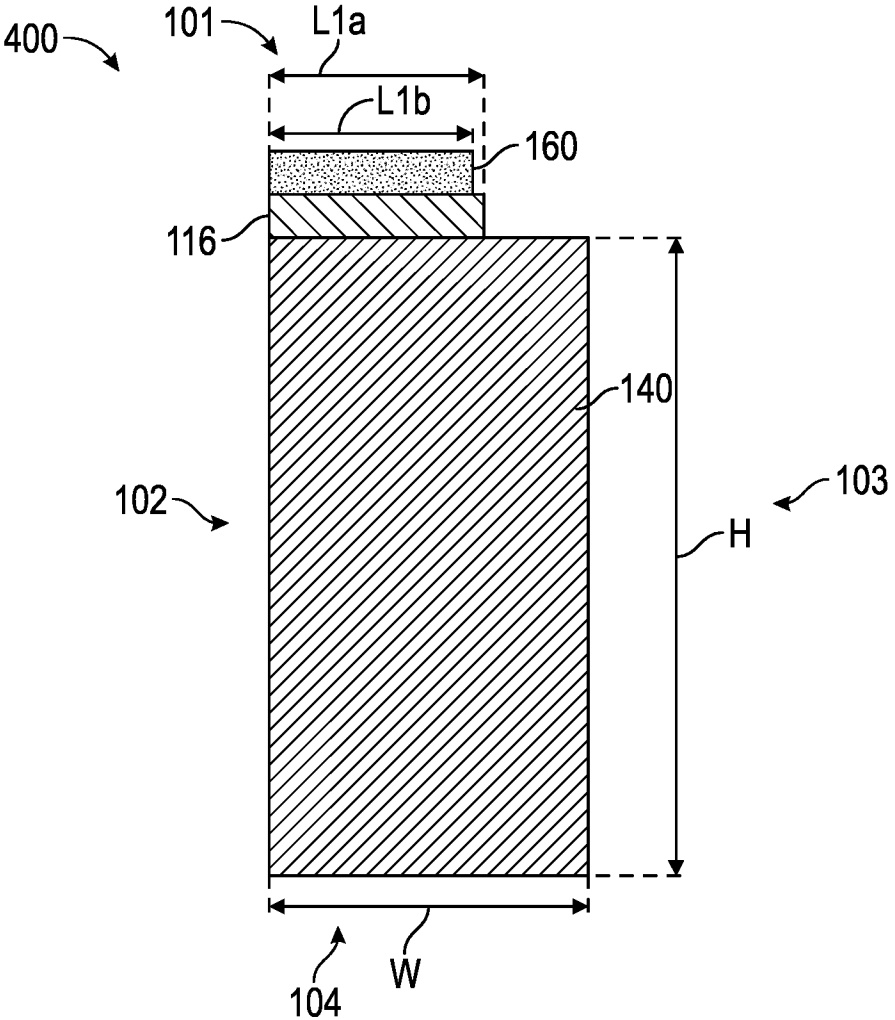
FIG. 8 shows a cross-section of a fourth compressible firestopping component.

FIGS. 8-9 shows a fourth compressible firestopping component 400 having the same structure as the component 100, but with the differences noted below. The compressible firestopping component 400 can include the elongate foam body or foam portion 140. The foam portion 140 can include or define a cross-sectional profile. The foam portion 140 can include the top side or the first side 101, the inner side or second side 102, the outer or third side 103, and/or the lower or fourth side 104. The foam portion 140 can have the height H and the width W.

The firestopping component 400 can include the sealing portion, sealing element or intumescent layer 116. The intumescent layer 116 can be positioned on one or more sides of the foam portion 140. As shown, the intumescent layer 116 is positioned along the upper or first side 101 of the foam portion 140. The intumescent layer 116 may comprise a flexible adhesive sealant. In some configurations, the intumescent layer 116 may additionally or alternatively comprise or be a fire-resistant or intumescent material that expands under elevated temperatures ("an intumescent layer or intumescent strip").

The intumescent layer 116 can have a width L1. The width L1*a* can extend from a first lateral edge to a second lateral edge. The width L1*a* can be less than or equal to the width W of the first side 101. The intumescent layer 116 can be spaced from or aligned with the corners of the fourth side 104.

The firestopping component 400 can include a double-sided tape layer 160. The tape layer 160 can be positioned on the intumescent layer 116, as shown. The tape layer 160 can cover a first portion of the intumescent layer 116 and leave a second portion uncovered or cover all of the intumescent layer 116. The tape layer 160 can have a width L1*b*. The width L1*b* can extend from a first lateral edge to a second lateral edge of the tape layer 160. The width L1*b* can be less than or equal to the width W of the first side 101 and/or the L1*b*. Desirably, the width L1*b* can be less than 50% of the width W or the width L1*b*. The tape layer 160 can be spaced from or aligned with one or both lateral edges of the strip 116. The double-sided tape layer 160 can include a release sheet (not shown).

By placing the tape layer 160 on the same side of the foam portion 140 as the sealing layer 116, the tape layer 160 and the sealing layer 116 can be applied more efficiently during manufacturing. Specifically, the tape layer 160 and the tape layer 160 and the sealing layer 116 can be applied simultaneously to the foam portion 140 during manufacture. Furthermore, placing the tape layer 160 on the same side of the foam portion 140 as the sealing layer 116, the firestopping component 400 to be packaged in a roll, which may include compression of the foam portion 140. In contrast, if one layer is running in one direction and another layer runs in a perpendicular direction, the resulting component would not be able to be rolled (i.e., without damage).

FIG. 9 shows the firestopping component 400 installed within a deflection gap of the exemplary stud-framed wall assembly 10. The component 400 can be attached with the ceiling 20 at the lower surface 23 by the tape layer 160 after framing the header track 12 and the stud 16, but before installation of the wallboard 18. To install the firestopping component 400, the release sheet can be removed from the tape layer 160. The tape layer 160 can then be adhered to lower surface 23, as illustrated. The wallboard 18 can then be installed on the stud 16. In one example, the wallboard 18 can be installed by sliding the upper edge 19 and the component 400 upwards to abut the lower side 104. This can ensure the firestopping component 100 blocks across the deflection gap. The wallboard 18 can also compress the firestopping component 400 within the deflection gap (e.g., between the upper edge of the drywall and the bottom 23 of the ceiling 20). This installation can eliminate the need to compress the foam portion 140 before insertion into the deflection gap.

Figure 10:
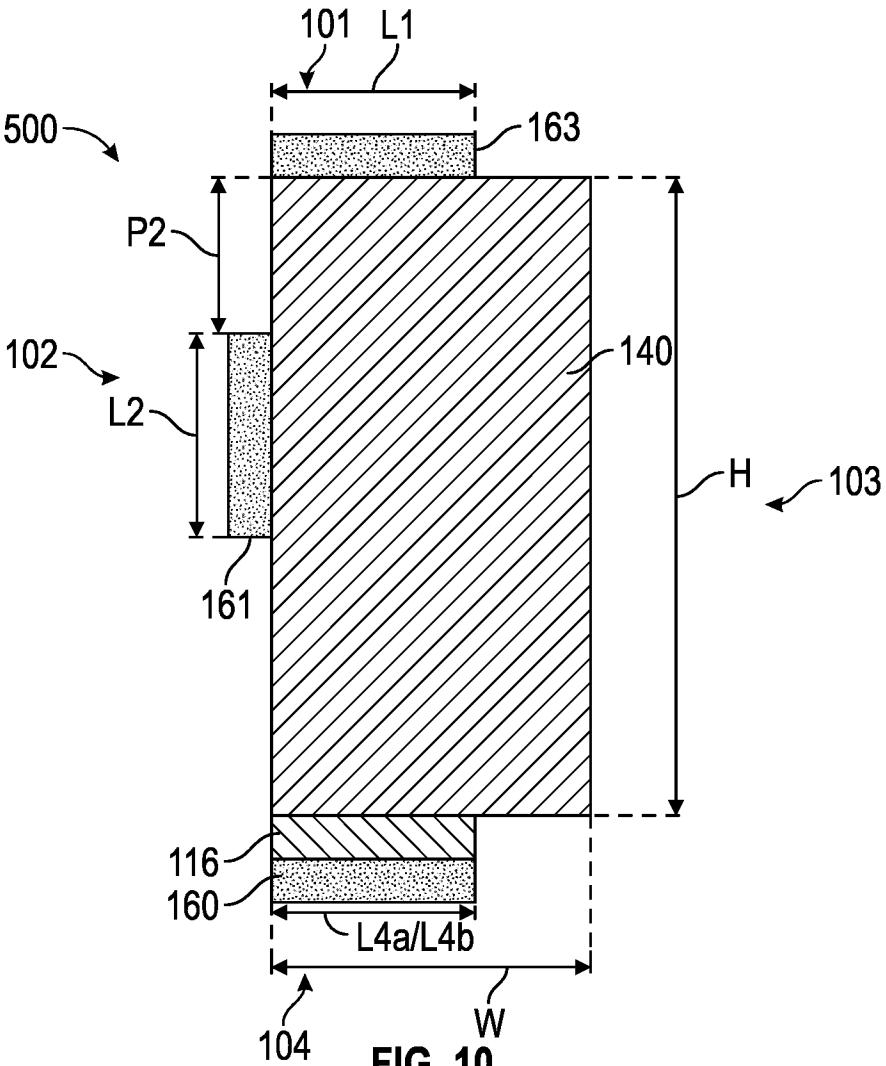
FIG. 10 shows a cross-section of a fifth compressible firestopping component.

FIG. 10 shows a fifth compressible firestopping component 500 having the same structure as the component 100, but with the differences noted below. The compressible firestopping component 500 can include the elongate foam body or foam portion 140. The foam portion 140 can include or define a cross-sectional profile. The foam portion 140 can include the top side or the first side 101, the inner side or second side 102, the outer or third side 103, and/or the lower or fourth side 104. The foam portion 140 can have the height H and the width W.

The firestopping component 500 can include the sealing portion, sealing element or intumescent layer 116. The intumescent layer 116 can be positioned on one or more sides of the foam portion 140. As shown, the intumescent layer 116 is positioned along the lower side 104 of the foam portion 140. The intumescent layer 116 may comprise a flexible adhesive sealant. The intumescent layer 116 can have a width L4*a*. The width L4*a* can extend from a first lateral edge to a second lateral edge. The width L4*a* can be less than or equal to the width W of the lower side 104. The intumescent layer 116 can be spaced from the corner of the lower side 104.

The firestopping component 500 can include an optional double-sided tape layer 161. The tape layer 161 can be positioned on one or more sides of the foam portion 140. As shown, the tape layer 161 is positioned along the second side 102 of the foam portion 140. The tape layer 161 can cover a first portion of the second side and leave a second portion uncovered. The tape layer 161 can have a width L2. The width L2 can extend from a first lateral edge to a second lateral edge of the tape layer 161. The width L2 can be less than or equal to the height H of the second side 102. Desirably, the width L2 can be less than 50% of the height H. The tape layer 161 can be spaced from the first corner and/or the second corner. The tape layer 161 can be spaced from the first corner by a spacing distance P2. The distance P2 can be less than 50% of the height H of the second side 102.

The firestopping component 500 can include a second optional double-sided tape layer 160. The tape layer 160 can be positioned on one or more sides of the foam portion 140. As shown, the tape layer 160 is positioned along the intumescent strip 116. The tape layer 160 can cover all or a portion of the intumescent strip 116. The tape layer 160 can have a width L4*b*. The width L4*b* can extend from a first lateral edge to a second lateral edge. The width L4*b* can be less than or equal to the width W of the fourth side 104 or the width L4*a* of the strip 116.

The firestopping component 500 can include a third optional double-sided tape layer 163. The tape layer 163 can be positioned on one or more sides of the foam portion 140. As shown, the tape layer 163 is positioned along the first side 101 of the foam portion 140. The tape layer 163 can cover a first portion of the first side 101 and leave a second portion uncovered. The tape layer 163 can have a width L1. The width L1 can extend from a first lateral edge to a second lateral edge of the tape layer 163. The width L1 can be less than or equal to the width W of the first side 101.

Figure 11:
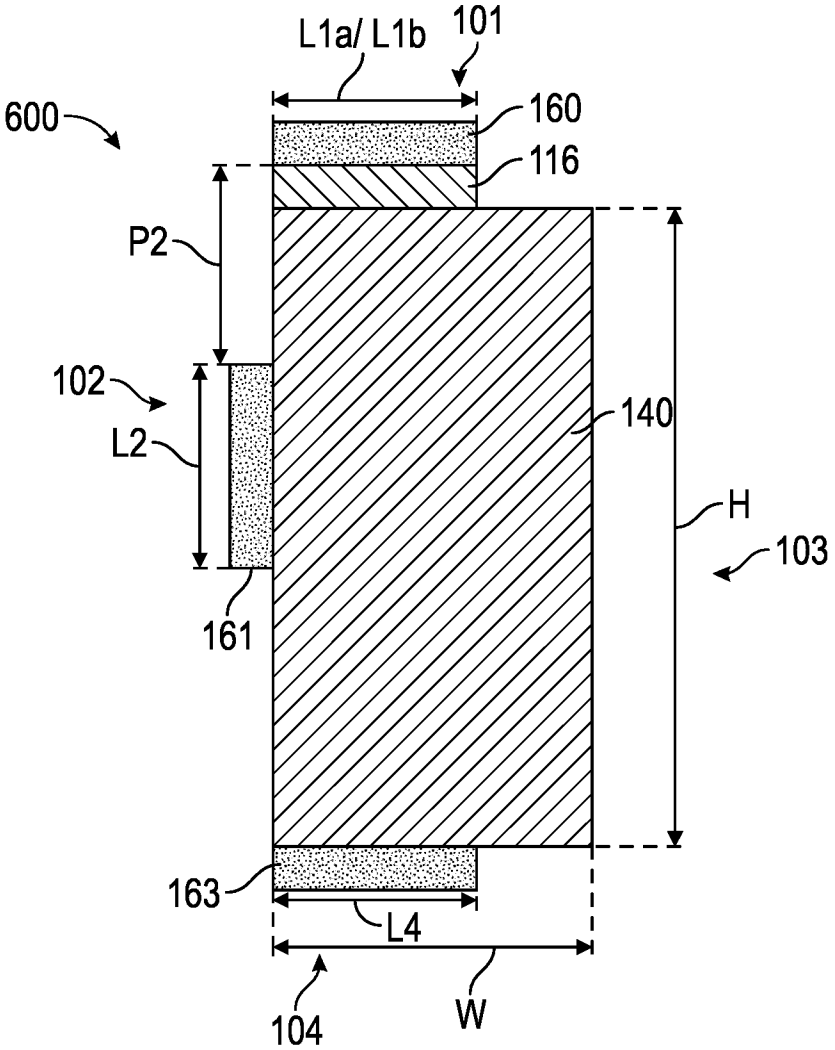
FIG. 11 shows a cross-section of a sixth compressible firestopping component.

FIG. 11 shows a sixth compressible firestopping component 600 having the same structure as the component 100, but with the differences noted below. The compressible firestopping component 600 can include the elongate foam body or foam portion 140. The foam portion 140 can include or define a cross-sectional profile. The foam portion 140 can include the top side or the first side 101, the inner side or second side 102, the outer or third side 103, and/or the lower or fourth side 104. The foam portion 140 can have the height H and the width W.

The firestopping component 600 can include the sealing portion, sealing element or intumescent layer 116. The intumescent layer 116 can be positioned on one or more sides of the foam portion 140. As shown, the intumescent layer 116 is positioned along the upper side 101 of the foam portion 140. The intumescent layer 116 may comprise a flexible adhesive sealant. The intumescent layer 116 can have a width L1*a*. The width L1*a* can extend from a first lateral edge to a second lateral edge. The width L1*a* can be less than or equal to the width W of the first side 101. The intumescent layer 116 can be spaced from the corner of the first side 101.

The firestopping component 600 can include an optional double-sided tape layer 161. The tape layer 161 can be positioned on one or more sides of the foam portion 140. As shown, the tape layer 161 is positioned along the second side 102 of the foam portion 140. The tape layer 161 can cover a first portion of the second side and leave a second portion uncovered. The tape layer 161 can have a width L2. The width L2 can extend from a first lateral edge to a second lateral edge of the tape layer 161. The width L2 can be less than or equal to the height H of the second side 102. Desirably, the width L2 can be less than 50% of the height H. The tape layer 161 can be spaced from the first corner and/or the second corner. The tape layer 161 can be spaced from the first corner by a spacing distance P2. The distance P2 can be less than 50% of the height H of the second side 102.

The firestopping component 200 can include a second optional double-sided tape layer 163. The tape layer 163 can be positioned on one or more sides of the foam portion 140. As shown, the tape layer 163 is positioned along the fourth side 104 of the foam portion 140. The tape layer 163 can cover a first portion of the fourth side 104 and leave a second portion uncovered. The tape layer 163 can have a width L4. The width L4 can extend from a first lateral edge to a second lateral edge of the tape layer 163. The width L4 can be less than or equal to the width W of the fourth side 104.

The firestopping component 600 can include a third optional double-sided tape layer 160. The tape layer 160 can be positioned on one or more sides of the foam portion 140. As shown, the tape layer 160 is positioned along the intumescent strip 116. The tape layer 160 can cover all or a portion of the intumescent strip 116. The tape layer 160 can have a width L1*b*. The width L1*b* can extend from a first lateral edge to a second lateral edge. The width L1*b* can be less than or equal to the width W of the first side 101 or the width L1*a* of the strip 116.

Certain Terminology

Terms of orientation used herein, such as "top," "bottom," "upper," "lower," "inner," "outer," and "end," are used in the context of the illustrated example. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular," "cylindrical," "semi-circular," or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain examples include or do not include, certain features, elements, and/or steps. Thus, such conditional language is not generally intended to imply that features, elements, and/or steps are in any way required for one or more examples.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain examples require the presence of at least one of X, at least one of Y, and at least one of Z.

The terms "approximately," "about," and "substantially" as used herein represent an amount close to the stated amount that still performs a desired function or achieves a desired result. For example, in some examples, as the context may dictate, the terms "approximately," "about," and "substantially," may refer to an amount that is within less than or equal to 10% of the stated amount. The term "generally" as used herein represents a value, amount, or characteristic that predominantly includes or tends toward a particular value, amount, or characteristic. As an example, in certain examples, as the context may dictate, the term "generally parallel" can refer to something that departs from exactly parallel by less than or equal to 20 degrees. All ranges are inclusive of endpoints.

SUMMARY

Several illustrative examples of joint assemblies and components have been disclosed. Although this disclosure has been described in terms of certain illustrative examples and uses, other examples and other uses, including examples and uses which do not provide all of the features and advantages set forth herein, are also within the scope of this disclosure. Components, elements, features, acts, or steps can be arranged or performed differently than described and components, elements, features, acts, or steps can be combined, merged, added, or left out in various examples. All possible combinations and subcombinations of elements and components described herein are intended to be included in this disclosure. No single feature or group of features is necessary or indispensable.

Certain features that are described in this disclosure in the context of separate implementations can also be implemented in combination in a single implementation. Conversely, various features that are described in the context of a single implementation also can be implemented in multiple implementations separately or in any suitable subcombination. Moreover, although features may be described above as acting in certain combinations, one or more features from a claimed combination can in some cases be excised from the combination, and the combination may be claimed as a subcombination or variation of a subcombination. The separation of various components in the implementations described above should not be understood as requiring such separation in all implementations, and it should be understood that the described components and systems can generally be integrated together in a single product or packaged into multiple products.

Further, while illustrative examples have been described, any examples having equivalent elements, modifications, omissions, and/or combinations are also within the scope of this disclosure. Moreover, although certain aspects, advantages, and novel features are described herein, not necessarily all such advantages may be achieved in accordance with any particular example. For example, some examples within the scope of this disclosure achieve one advantage, or a group of advantages, as taught herein without necessarily achieving other advantages taught or suggested herein. Further, some examples may achieve different advantages than those taught or suggested herein.

Some examples have been described in connection with the accompanying drawings. The figures are drawn and/or shown to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various examples can be used in all other examples set forth herein. Additionally, any methods described herein may be practiced using any device suitable for performing the recited steps.

For purposes of summarizing the disclosure, certain aspects, advantages and features of the inventions have been described herein. Not all, or any such advantages are necessarily achieved in accordance with any particular example of the inventions disclosed herein. No aspects of this disclosure are essential or indispensable. In many examples, the devices, systems, and methods may be configured differently than illustrated in the figures or description herein. For example, various functionalities provided by the illustrated modules can be combined, rearranged, added, or deleted. In some implementations, additional or different processors or modules may perform some or all of the functionalities described with reference to the examples described and illustrated in the figures. Many implementation variations are possible. Any of the features, structures, steps, or processes disclosed in this specification can be included in any example.

In summary, various examples of joints and joint components have been disclosed. This disclosure extends beyond the specifically disclosed examples to other alternative examples and/or other uses of the examples, as well as to certain modifications and equivalents thereof. Moreover, this disclosure expressly contemplates that various features and aspects of the disclosed examples can be combined with, or substituted for, one another. Accordingly, the scope of this disclosure should not be limited by the particular disclosed examples described above, but should be determined only by a fair reading of the claims.

What is claimed is:

1. A head of wall assembly, comprising:

an overhead structure;

a header track attached with the overhead structure, the header track including a first flange and a second flange coupled to a web;

at least one stud attached to the header track and having an upper end received between the first and second flanges;

a wallboard attached to the at least one stud;

a deflection gap disposed between an upper edge of the wallboard and the overhead structure;

an elongate, compressible firestopping component received within the deflection gap to block passage of fire, heat, smoke and/or sound, through the deflection gap, the elongate, compressible firestopping component comprising:

a first end;

a second end;

a compressible foam material having rectangular cross-sectional profile and including a first side and a second side meeting at a corner, a third side opposite the second side, and a fourth side opposite the first side, the rectangular cross-sectional profile extending from the first end to the second end;

the first side including an intumescent strip having a first width, the first width extending from a first edge to a second edge, the first edge of the intumescent strip located at the corner;

the second side including a first portion covered by a factory-applied double-sided tape layer and a second uncovered portion, the double-sided tape layer having a second width, the second width extending from a first edge to a second edge, the first edge of the double-sided tape layer, located at the corner, such that the first edge of the double-sided tape layer and the first side of the compressible foam material are coplanar;

wherein the first width of the intumescent strip is greater than 50% of a width of the compressible foam material;

wherein the second width of the double-sided tape layer is less than 50% of a height of the compressible foam material; and wherein a first face of the double-sided tape layer is attached to the second side of the compressible foam material, a second face of the double-sided tape layer is attached to an outer surface of the first flange of the header track, and the second uncovered portion of the second side faces the outer surface of the first flange;

wherein the intumescent strip contacts the overhead structure;

wherein the fourth side of the compressible foam material contacts the upper edge of the wallboard; and wherein the double-sided tape layer comprises a polypropylene backing material and a tackified acrylic adhesive.

2. The assembly of claim 1, wherein the cross-sectional profile of the compressible foam material comprises a rectangular cross-sectional profile having the first and second side and further including a third side and a fourth side.

3. The assembly of claim 2, wherein the first and second side meet at a corner, the fourth side is opposite the first side, and the third side opposite the second side.

4. The assembly of claim 3, wherein the first edge of the intumescent strip aligns with the corner.

5. The assembly of claim 3, wherein the first edge of the double-sided tape layer is aligned with the corner.

6. The assembly of claim 2, wherein the second face of the double-sided tape layer is attached to an outer surface of the first flange of the header track and the second uncovered portion of the second side faces the outer surface of the first flange.

7. The assembly of claim 6, further comprising a second double-sided tape layer attached between the fourth side of the compressible material and the upper edge of the wallboard.

8. The assembly of claim 7, wherein the intumescent strip is disposed between the overhead structure and the first side of the compressible material.

9. A head of wall assembly, comprising:

an overhead structure;

a header track attached to the overhead structure, the header track including a first flange and a second flange coupled to a web;

at least one stud attached to the header track and having an upper end received between the first and second flanges;

a wallboard attached to the at least one stud;

a deflection gap disposed between an upper end of the wallboard and the overhead structure;

an elongate, compressible firestopping component received within the deflection gap to block passage of fire, heat, smoke and/or sound, through the deflection gap, the elongate, compressible firestopping component comprising:

a first end;

a second end;

a compressible foam material having a cross-sectional profile including a first side and a second side, the cross-sectional profile extending from the first end to the second end;

the first side including an intumescent strip having a first width, the first width extending from a first edge to a second edge of the intumescent strip;

the second side including a first portion covered by a factory-applied double-sided tape layer and a second uncovered portion, the double-sided tape layer having a second width, the second width extending from a first edge to a second edge of the double-sided tape layer;

wherein a first face of the double-sided tape layer is attached to the second side of the compressible foam material and a second face of the double-sided tape layer is opposite the first face.

10. A head of wall assembly, comprising:

an overhead structure;

a header track attached with the overhead structure, the header track including a first flange and a second flange coupled to a web;

at least one stud attached to the header track and having an upper end received between the first and second flanges;

a wallboard attached to the at least one stud;

a deflection gap disposed between an upper edge of the wallboard and the overhead structure;

an elongate, compressible firestopping component received within the deflection gap to block passage of fire, heat, smoke and/or sound, through the deflection gap, the elongate, compressible firestopping component comprising:

a first end;

a second end;

a compressible foam material having rectangular cross-sectional profile and including a first side and a second side meeting at a corner, a third side opposite the second side, and a fourth side opposite the first side, the rectangular cross-sectional profile extending from the first end to the second end;

the first side including an intumescent strip having a first width, the first width extending from a first edge to a second edge, the first edge of the intumescent strip located at the corner;

the second side including a first portion covered by a factory-applied double-sided tape layer and a second uncovered portion, the double-sided tape layer having a second width, the second width extending from a first edge to a second edge, the first edge of the double-sided tape layer located at the corner, such that the first edge of the double-sided tape layer and the first side of the compressible foam material are coplanar;

wherein the second width of the double-sided tape layer is less than 50% of a height of the compressible foam material; and wherein a first face of the double-sided tape layer is attached to the second side of the compressible foam material, a second face of the double-sided tape layer is attached to an outer surface of the first flange of the header track, and the second uncovered portion of the second side faces the outer surface of the first flange;

wherein the intumescent strip contacts the overhead structure;

wherein the fourth side of the compressible foam material contacts the upper edge of the wallboard; and wherein the first width of the intumescent strip is less than a width of the first side of the compressible foam material.

11. A head of wall assembly, comprising:

an overhead structure;

a header track attached with the overhead structure, the header track including a first flange and a second flange coupled to a web;

at least one stud attached to the header track and having an upper end received between the first and second flanges;

a wallboard attached to the at least one stud;

a deflection gap disposed between an upper edge of the wallboard and the overhead structure;

an elongate, compressible firestopping component received within the deflection gap to block passage of fire, heat, smoke and/or sound, through the deflection gap, the elongate, compressible firestopping component comprising:

a first end;

a second end;

a compressible foam material having rectangular cross-sectional profile and including a first side and a second side meeting at a first corner, a third side opposite the second side, and a fourth side opposite the first side, the fourth side and the second side meeting at a second corner, the rectangular cross-sectional profile extending from the first end to the second end;

the first side including an intumescent strip having a first width, the first width extending from a first edge to a second edge, the first edge of the intumescent strip located at the first corner;

the second side including a first portion covered by a factory-applied double-sided tape layer and a second uncovered portion, the double-sided tape layer having a second width, the second width extending from a first edge to a second edge, the first edge and the second edge of the double-sided tape layer positioned on the second side, the first edge closer to the first corner than the second corner, wherein the second width of the double-sided tape layer is less than 50% of a height of the compressible foam material; and wherein a first face of the double-sided tape layer is attached to the second side of the compressible foam material, a second face of the double-sided tape layer is attached to an outer surface of the first flange of the header track, and the second uncovered portion of the second side faces the outer surface of the first flange;

wherein the intumescent strip contacts the overhead structure;

wherein the fourth side of the compressible foam material contacts the upper edge of the wallboard; and wherein the elongate, compressible firestopping component is configured to be secured to the header track by the double-sided tape layer prior to the wallboard being attached to the at least one stud.

* * * * *